US007823937B2

(12) United States Patent
Vitry

(10) Patent No.: US 7,823,937 B2
(45) Date of Patent: Nov. 2, 2010

(54) ROTARY PAWL GLOVE BOX LATCH

(75) Inventor: Fabrice Vitry, Worcester (GB)

(73) Assignee: Southco, Inc., Concordville, PA (US)

( * ) Notice: Subject to any disclaimer, the term of this patent is extended or adjusted under 35 U.S.C. 154(b) by 854 days.

(21) Appl. No.: 11/686,568

(22) Filed: Mar. 15, 2007

(65) Prior Publication Data

US 2007/0216173 A1 Sep. 20, 2007

Related U.S. Application Data

(60) Provisional application No. 60/782,778, filed on Mar. 16, 2006.

(51) Int. Cl.
*E05B 3/00* (2006.01)

(52) U.S. Cl. ..... 292/336.3; 70/208

(58) Field of Classification Search ..... 292/336.3, 292/DIG. 31, 170, 173, 224, 252, 38, 216, 292/219, 226, 200, 210, 304; 70/208
See application file for complete search history.

(56) References Cited

U.S. PATENT DOCUMENTS 2,172,586 A * 9/1939 Jacobi ..... 70/84
2,649,322 A * 8/1953 Mack ..... 292/173
3,581,532 A * 6/1971 Andersen et al. ..... 70/84
4,747,632 A * 5/1988 Joy ..... 292/347
4,858,973 A * 8/1989 Ogasawara et al. ..... 292/347
5,098,141 A * 3/1992 Bull ..... 292/252
5,234,238 A * 8/1993 Takimoto ..... 292/216
5,263,346 A * 11/1993 Sato et al. ..... 70/210
5,292,159 A * 3/1994 Sandhu et al. ..... 292/173
5,413,391 A * 5/1995 Clavin et al. ..... 292/170
5,484,178 A * 1/1996 Sandhu et al. ..... 292/173
5,603,535 A * 2/1997 Antonucci et al. ..... 292/128
5,630,630 A * 5/1997 Price et al. ..... 292/128
5,676,003 A * 10/1997 Ursel et al. ..... 70/472
5,799,517 A * 9/1998 Hattori et al. ..... 70/247
5,820,175 A * 10/1998 Clavin ..... 292/165
5,823,583 A * 10/1998 Sandhu et al. ..... 292/173
5,927,772 A * 7/1999 Antonucci et al. ..... 292/336.3
6,023,953 A * 2/2000 Vickers et al. ..... 70/208

(Continued)

FOREIGN PATENT DOCUMENTS

GB 561538 5/1944

*Primary Examiner*—Carlos Lugo
*Assistant Examiner*—Kristina R Fulton
(74) *Attorney, Agent, or Firm*—Paul & Paul

(57) ABSTRACT

A slam to close, glove box latch includes a housing, a paddle structure connected to rotate on the housing, a rotary pawl mounted to rotate in the housing, and a lock plate carried by the paddle structure to selectively engage the rotary pawl to inhibit its movement. The rotary pawl is spring biased to the open position. The paddle structure is spring biased to the closed position. The paddle structure includes guideways in which the lock plate operates. When the paddle is moved to the open position, the pawl is released to rotate open and the lock plate is carried to an interference-friction position with the pawl whereby the paddle is held in the open position. When the pawl is closed by the slam action of the latch, the interference-friction with the lock plate is released and the paddle structure returns to the closed position. Biasing is limited to two springs. The volume (envelope) of the latch is minimized.

20 Claims, 32 Drawing Sheets

U.S. PATENT DOCUMENTS 6,048,006 A * 4/2000 Antonucci et al. ..... 292/336.3
6,109,669 A * 8/2000 Pinkow ..... 292/175
6,145,352 A * 11/2000 Vickers et al. ..... 70/208
6,152,501 A * 11/2000 Magi et al. ..... 292/336.3
6,761,382 B2 * 7/2004 Ji et al. ..... 292/131
7,004,517 B2 * 2/2006 Vitry et al. ..... 292/213
7,048,311 B2 * 5/2006 Sawatani et al. ..... 292/33
7,065,992 B2 * 6/2006 Talukdar et al. ..... 70/208
7,080,531 B2 * 7/2006 Vitry et al. ..... 70/208
7,083,205 B2 * 8/2006 Hall ..... 292/34
7,118,142 B2 * 10/2006 Xu ..... 292/139
7,182,374 B2 * 2/2007 Figge et al. ..... 292/334
7,185,927 B2 * 3/2007 Talukdar et al. ..... 292/172
7,198,305 B2 * 4/2007 Vitry ..... 292/170
7,204,528 B2 * 4/2007 Vitry et al. ..... 292/165
7,313,937 B2 * 1/2008 Straka, Jr. ..... 70/137
7,383,707 B2 * 6/2008 Yamada et al. ..... 70/208
7,399,009 B2 * 7/2008 Hall et al. ..... 292/100
7,475,929 B2 * 1/2009 Yamada ..... 296/24.34
2001/0027667 A1 * 10/2001 Pinkow et al. ..... 70/208
2002/0171248 A1 * 11/2002 Diss et al. ..... 292/164
2004/0017088 A1 * 1/2004 Sawatani et al. ..... 292/178
2004/0070213 A1 * 4/2004 Vitry ..... 292/110
2004/0189012 A1 * 9/2004 Katou et al. ..... 292/34
2005/0067840 A1 * 3/2005 Koveal et al. ..... 292/95
2006/0255596 A1 * 11/2006 Yong ..... 292/173
2007/0163310 A1 * 7/2007 Ookawara et al. ..... 70/208
2007/0186598 A1 * 8/2007 Najima ..... 70/208
2007/0216173 A1 * 9/2007 Vitry ..... 292/336.3
2008/0042450 A1 * 2/2008 Jianping et al. ..... 292/216
2008/0157546 A1 * 7/2008 Vitry et al. ..... 292/226
2008/0169657 A1 * 7/2008 Horton et al. ..... 292/220
2009/0179438 A1 * 7/2009 Horton et al. ..... 292/336.3

* cited by examiner

Fig. 38d
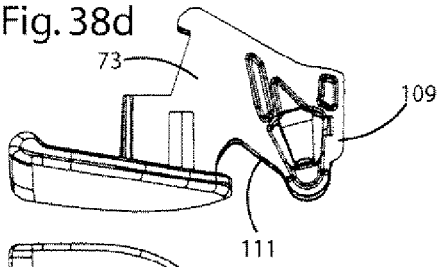
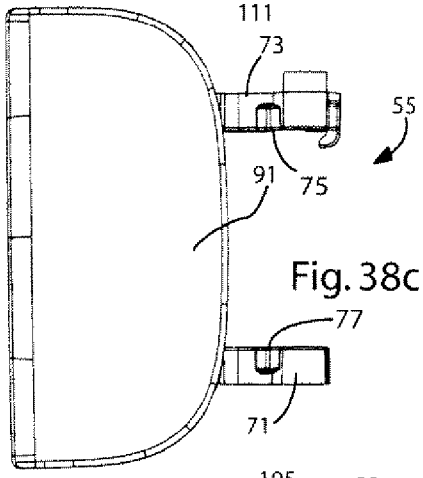
Fig. 38c
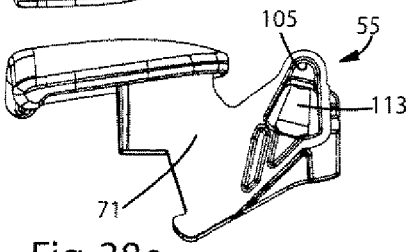
Fig. 38e
Fig. 38a
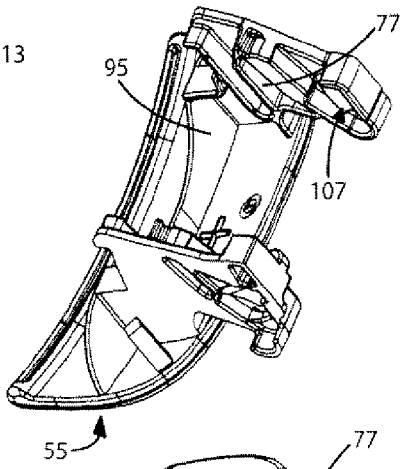
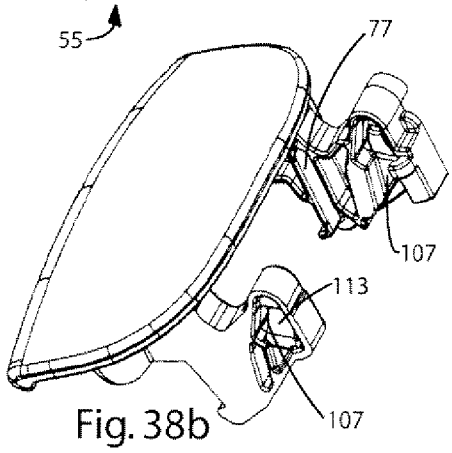
Fig. 38b

ROTARY PAWL GLOVE BOX LATCH

PRIOR APPLICATIONS

This application claims priority of U.S. Provisional Application 60/782,778 filed Mar. 16, 2006, for Rotary Pawl Glove Box Latch, which is incorporated herein by reference, in its entirety.

BACKGROUND OF THE INVENTION

The present invention is directed to glove box latches for automobiles and the like. Specifically, it is related to slam to close, rotary pawl latches.

Compartments and glove boxes found in transportation vehicles, such as automobiles and the like, generally have slam to close latches. These slam to close latches function to permit an operator to close a panel, a glove box door, or a compartment with a pushing motion thereby also seating the latch against a striker and thereby also closing the latch into a locked position.

The movement and vibration experienced in such vehicles has promoted the use of rotary pawl latches which positively engage a wire (bar-type) striker. The objective is for the latch to hold the compartment or glove box closed even when subjected to excessive travel vibration or when subjected to body torque and jarring as is encountered in an accident.

The increasing use of plastics in automobile interiors has encouraged the increased use of plastics for latch structural materials. Components of these plastic latches, however, wear, fatigue and otherwise fail under use more readily than their metal counterparts. Besides functionality and operating features, design considerations for such latches now include strength of materials considerations as well as ease of operation, durability, and fatigue points. Further, latch size and manufacturing costs may also be a consideration. The more component parts in a latch, generally, the larger the "envelope" which the latch occupies. Reducing the number of components often leads to reduced envelope size.

Some latches include a goose neck shaped handle levers which permit the pivot point for the handle to be located below the face of the panel or door to which the latch is mounted and permits the handle to be pulled outward above the panel or door.

Young, U.K. patent GB 0561538, shows a latch having a base plate, a recess in the base plate, an eccentric pivoted cam plate which acts as a rotary pawl, being biased to the open position by a spring, for engaging and holding onto a bolt 1226 which acts as a striker, and a catch which is biased to the closed position by second spring. The catch acts like a lock bar to hold the rotary pawl 8 in the locked position.

Both Scania, A.B., Sodertaije, Sweden and Southco, Inc., Concordville, Pa., USA have introduced slam to close, rotary pawl glove box latches with gooseneck-shaped handle levers. These latches are constructed of plastic components with multiple biasing springs. Such a latch is described by Jeffrey Antonucci, et al. U.S. Pat. No. 5,927,772 and U.S. Pat. No. 6,048,006.

These latches have several issues which the present invention addresses.

It is an objective of the present invention to develop a slam to close, rotary pawl latch of reduced volume (reduced envelope size).

It is secondarily an objective to develop such a latch with a minimized number of components.

It is also an objective to develop such a latch with a minimized number of biasing springs.

It is further an objective to develop such a latch which is actuated to open by pulling on the paddle of the latch, wherein the paddle is held in the open position until the latch is closed.

It is also further an objective to develop such a latch which minimizes rattle and noise when subjected to vibration.

SUMMARY OF THE INVENTION

The objectives the present invention are realized in a slam to close, glove box latch which has a housing, a paddle structure connected to rotate on the housing, a rotary pawl mounted to rotate in the housing, and a lock plate carried by the paddle structure to selectively engage the rotary pawl to inhibit its movement. The rotary pawl is spring biased with a loop-style torsion spring to the open position. The paddle structure is spring biased with a torsion spring to the closed position. The paddle structure includes guideways in which the lock plate operates.

When the paddle is moved to the open position, the pawl is released to rotate open and the lock plate is carried to an interference-friction position with the pawl. This interference-friction position fixes the position of both the pawl and the lock plate. Fixing the position of the lock plate thereby fixes the position of the paddle structure as the lock plate binds (interferes) against its lock plate guideways. Thereby the paddle is held in the open position.

When the pawl is forced closed by the slam action of the latch, the lock plate interference-friction with the paddle guideways is released, i.e., overcome, and the paddle structure returns to the closed position. Biasing is limited to two springs. The volume (envelope) of the latch is minimized from that of latches with more components including more biasing springs. This is further facilitated by having raised pivot points.

The slam action of the latch occurs under the operator's forcing closed the panel or door to which the latch is attached or by forcing against the latch paddle. Either operation causes the pawl to engage a striker and force its rotation and thereby disengaging the interference-friction.

The housing includes a wall which abuts the paddle structure to close-off the operator end of the latch. The housing also includes bumpers against which the paddle structure rides, or abuts, in the closed position. The latch is limited to two rotating shafts, one of which is a split shaft with stub shaft ends. The latch can be assembled without tools by snap-in assembly, i.e., it can be manually assembled. Once snapped together the latch is not intended to be disassembled.

BRIEF DESCRIPTION OF THE DRAWINGS

The features, advantage and operation of the present invention will become readily apparent and further understood from a reading of the following detailed description with the accompanying drawings, in which like numerals refer to like elements, and in which:

FIGS. 38*a* through 38*e* are perspective, top plan and side views of the paddle member;

DETAILED DESCRIPTION OF THE INVENTION

Figure 1:
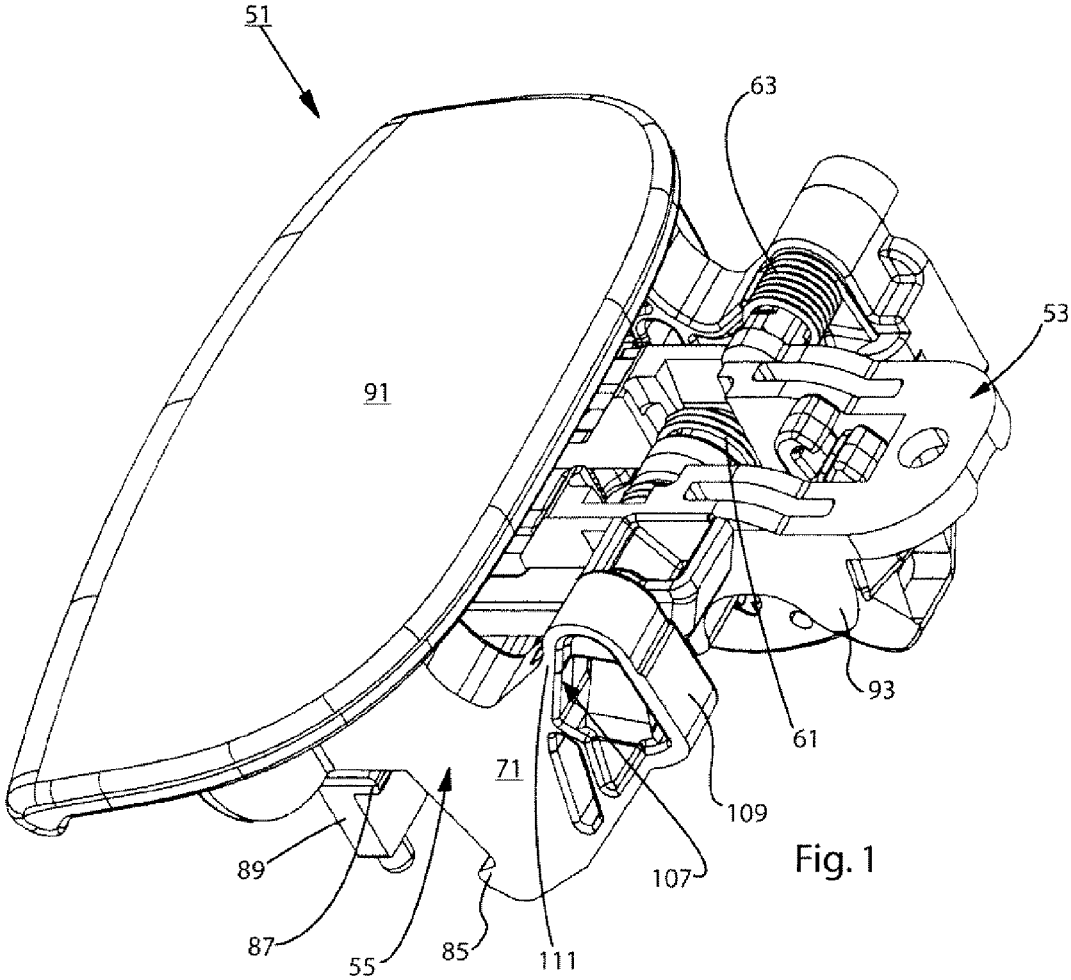
FIG. 1 is a perspective view of the outside of the glove box latch assembly of the present invention in the closed position.
Figure 2:
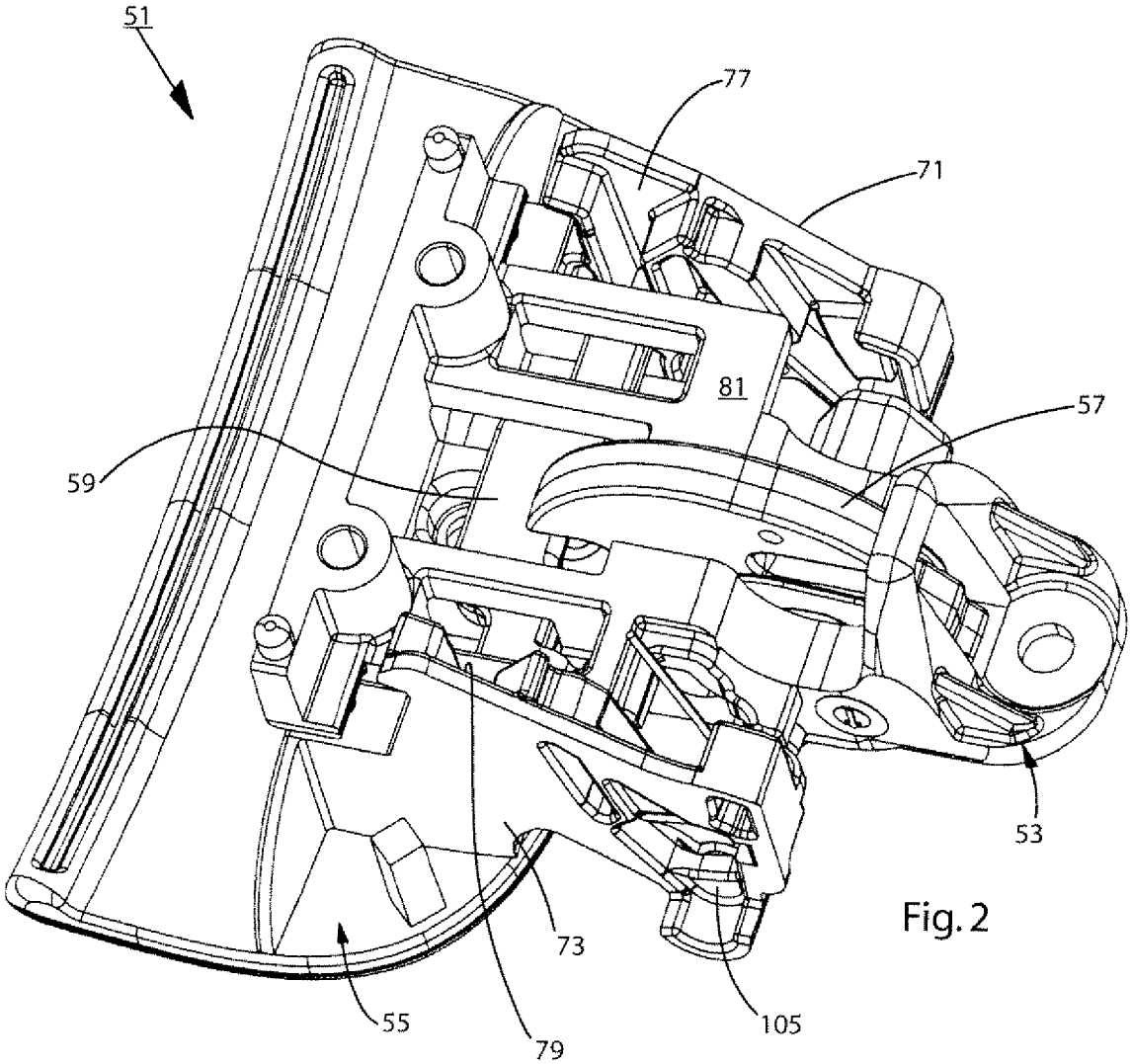
FIG. 2 is a perspective view of the inside, i.e., underside, of the closed glove box latch assembly of FIG. 1.
Figure 3:
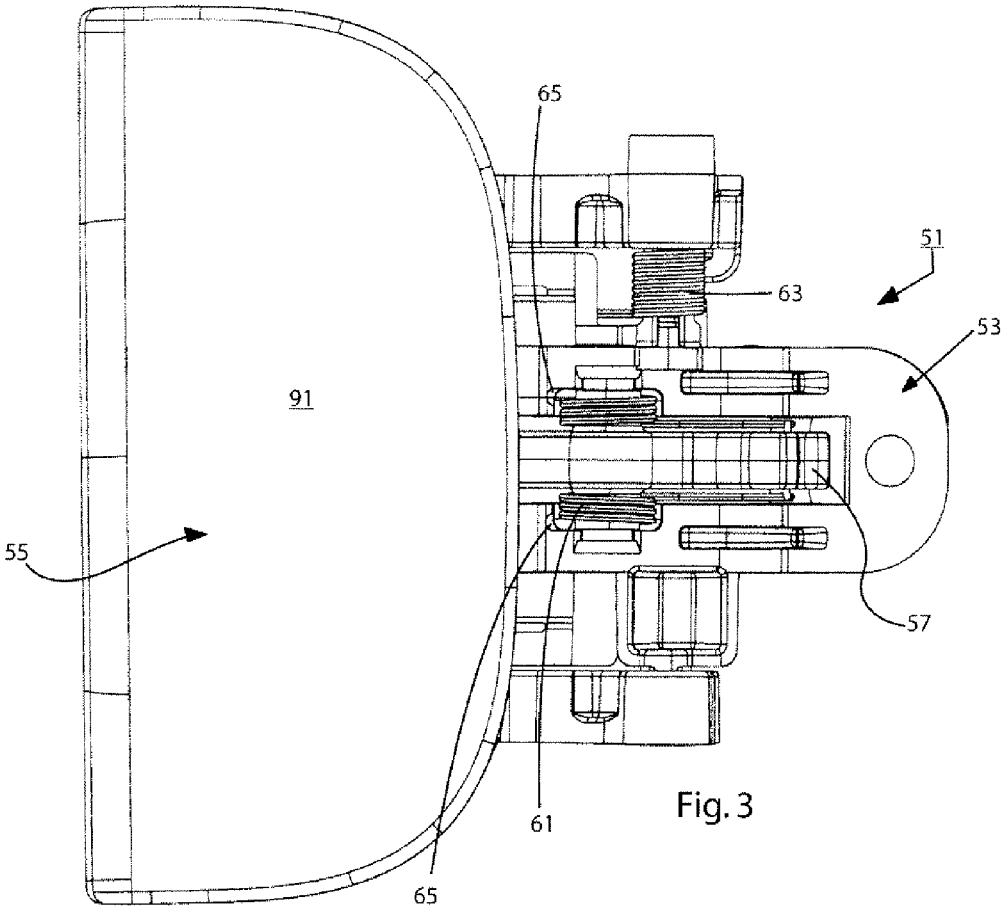
FIG. 3 is an outside plan view of the closed glove box latch assembly of FIG. 1.

The present invention is a slam to close, glove box latch assembly 51, FIGS. 1-6. The latch is a single point glove box latch with a housing 53 and a paddle 55 actuator. The latch assembly 51 includes a rotary pawl 57, a fully guided lock plate 59, and has a goose neck style pivot point 83. The paddle 55 is biased closed with a torsion spring 63. The pawl 57 is biased to the open position with a second torsion spring 61.

The latch assembly 51 is actuated by pulling on the paddle 55. The paddle 55 then remains in the open position until the latch is closed. The latch is closed by pushing on the paddle 55 to cause the rotary pawl 57 to interact with a striker wire 151. The lock plate 59, being fully guided, thereby reduces or eliminates rattle sounds or noise from the latch assembly 51.

The latch assembly 51, FIGS. 1-6, has housing 53 with the paddle 55 mounted to rotate on the housing 53 and the rotary pawl 57 mounted to rotate within the housing 53. The lock plate 59 within the housing and positioned between its guideways 75, 77 is carried by the paddle structure 55 as the paddle 55 is moved to selectively engage the rotary pawl 57 to inhibit its movement. A raised pivot point 83 for the paddle 55 and pawl 57 facilitates a latch assembly 51 with a lower profile and reduced volume (envelope).

The glove box latch assembly 51 is shown in its fully closed position in FIGS. 1-6. The rotary pawl 57 is spring biased to the open position by a loop-style torsion spring 61 which has coils 62 on either side of the pawl 57. The paddle structure 55 is spring biased to the fully closed position by a torsion spring 63 which has a single set of coils and a pair of legs 67, 69 extending therefrom. The pawl loop-style torsion spring 61 has two end legs 65 which operate against the housing 53 and a loop 64 which operates against the pawl 57. The paddle torsion spring 63 has a first end leg 67 which acts against the housing 53 and a second end leg 69 which acts against the paddle structure 55.

The paddle structure 55 includes a pair of parallel extending (pivot arms) walls 71, 73, FIGS. 2, 4, 5 and 6. The pivot arm walls 71, 73 are goose neck shaped. Each pivot arm wall 71, 73, includes a respective guideway 75, 77 in which the lock plate 59 operates, a pivot point 83, and a hook-like bumper member 85 at the "elbow" of the goose neck shape. These opposed facing guideways 75 and 77 extend in parallel, each along a respective wall 71 and 73. The lock plate 59 is an elongate structure with and end foot 79 at either end. These end feet 79 operate in a respective guide way 75, 77 whereby the lock plate 59 extends between the guideway channels 75 and 77. The bottom wall 81, FIGS. 2, 6, of the housing 53 extends over the lock plate 59.

Figure 4:
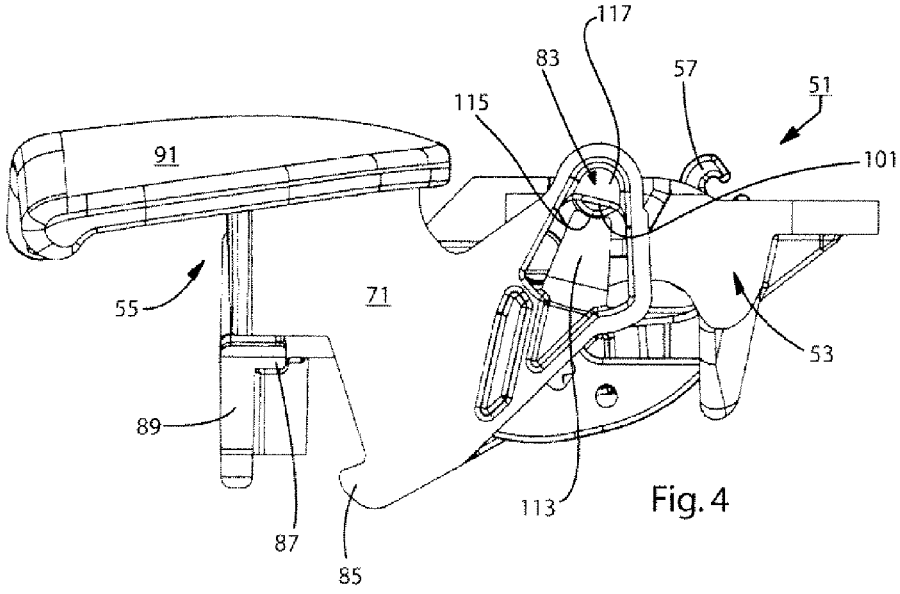
FIG. 4 is a right side view of the closed glove box latch assembly of FIG. 1.
Figure 5:
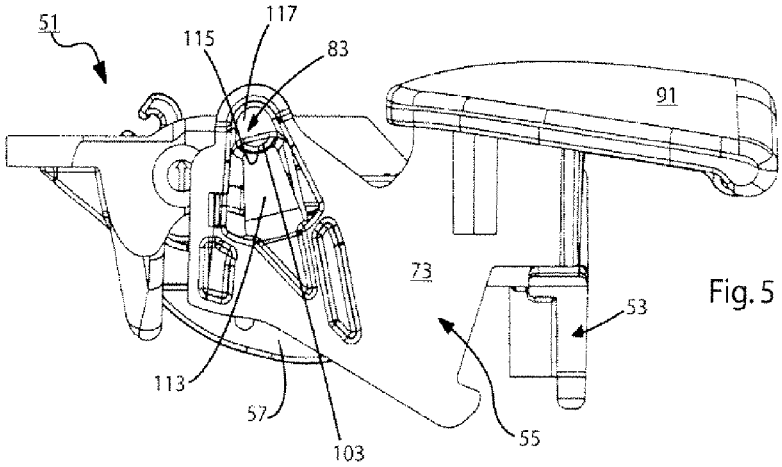
FIG. 5 is a left side view of the closed glove box latch assembly of FIG. 1.
Figure 7:
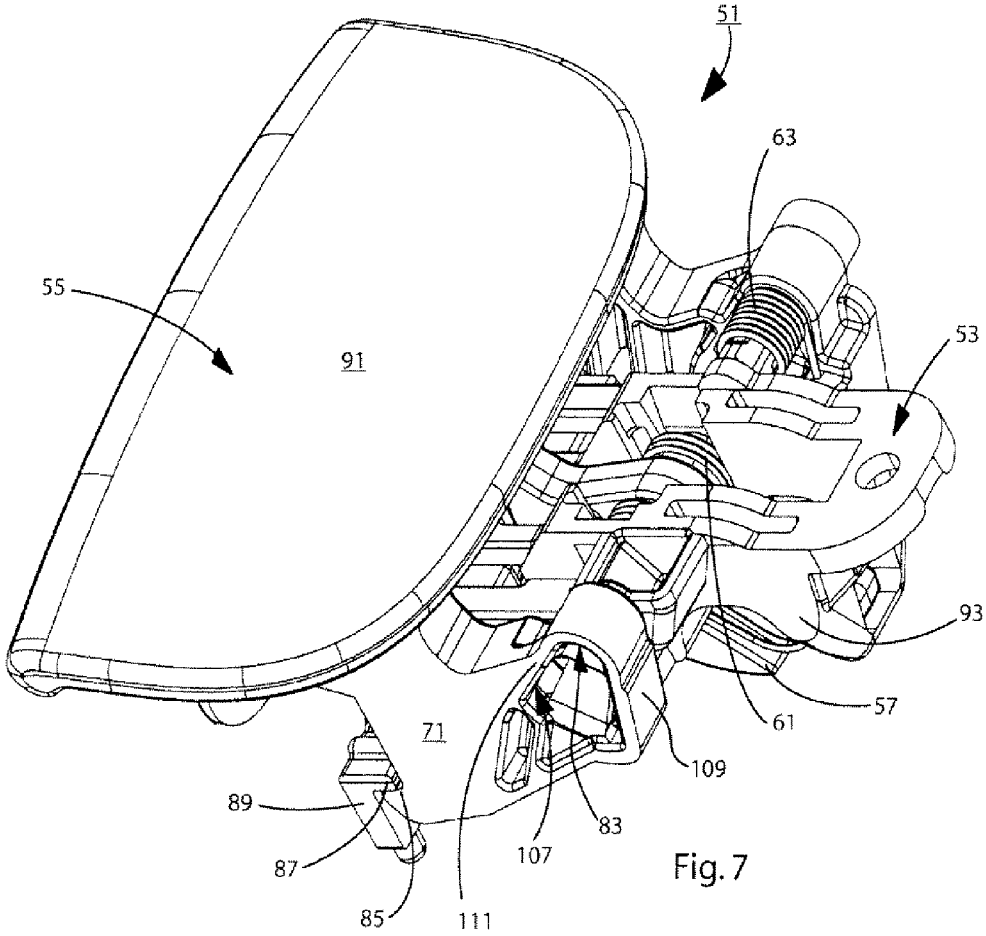
FIG. 7 is a perspective view of the outside of the glove box latch assembly of the present invention in the open position.
Figure 8:
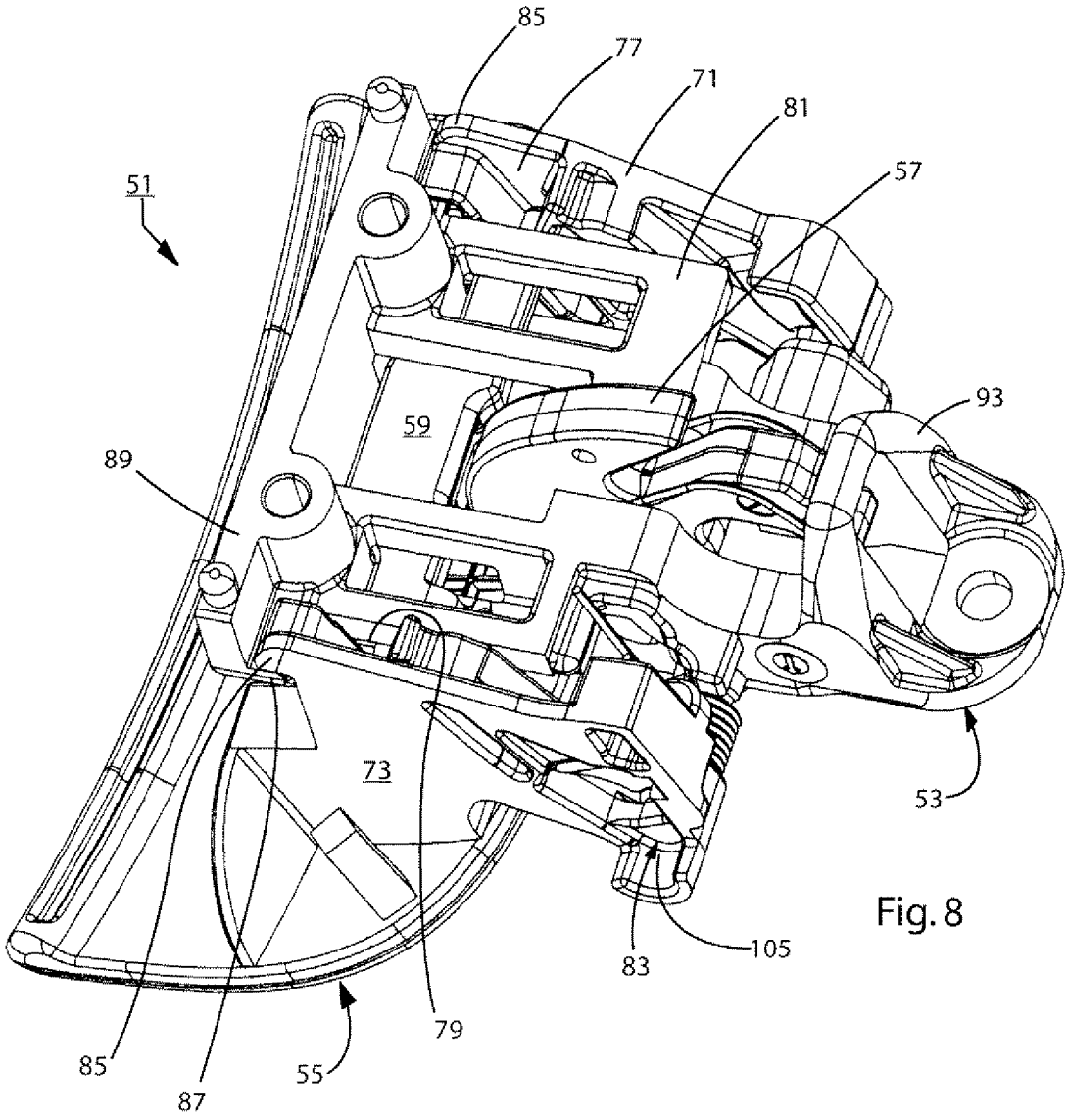
FIG. 8 is a perspective view of the inside of the open glove box latch assembly of FIG. 7.
Figure 10:
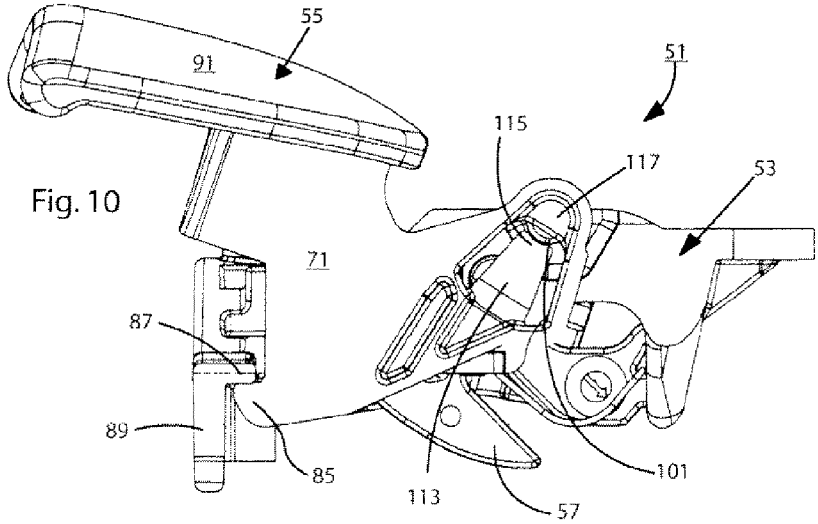
FIG. 10 is a right side view of the open glove box latch assembly of FIG. 7.

The paddle 55 has a goose neck pivot point 83, FIGS. 4, 5. This permits for a smaller gap to be required between the paddle 55 and any glove box to which the latch assembly 51 is mounted. The use of the torsion springs 61, 63 instead of compression springs reduces or eliminates the "squeak" noise found with a compression spring. The lock plate 59 is constrained by the housing 53 bottom wall 81 and the guide ways 75, 77 in the paddle parallel extending side walls 71, 73. This constraint prevents unwanted movement or vibration of the lock plate 59. Any vibration which arises in the paddle structure 55 is dampened by its torsion spring 63 which is always under some tension. Any vibration which arises in the rotary pawl 57 is dampened by its torsion spring 61 which is always under some tension. The lock plate 59 is sized to have each of its feet 79 exert pressure against the back wall of the respective guideways 75, 77, whereby a "living-spring" action is created on the lock plate 59.

The lock plate 59 engages the rotary pawl 57 with its tapered surface 119 with a friction-interference engagement when the paddle 55 is fully opened and the paddle 55 side walls 71, 73 have fully rotated about the pivot point 83. The rotational travel of each paddle side wall 71, 73 is limited by the abutment of a projecting finger 85 on each side wall 71, 73 against a projecting shoulder 87 on each side of the housing back wall 89, FIGS. 7-12. This provides an audible abutment sound when the finger 85 strikes the shoulder 87.

FIGS. 7-12 show the latch assembly 51 in the open position. In the open position, the gripping plate 91 of the paddle structure 55 is raised, i.e., pivoted outwardly or upwardly as the case may be. The open position, FIGS. 7-12 is achieved by an operator pulling on the gripping plate 91 against the paddle torsion spring 63 force. In the open position, the pawl 57 is free to rotate to its open position under its spring 61 force which causes the pawl 57 to rotate away from the hook-like member 93 portion of the housing 53, FIGS. 8 and 12. The housing hook member 93 completes the capture of a striker wire when the pawl 57 is closed into the hook member 93 wall extension.

Figure 3A:
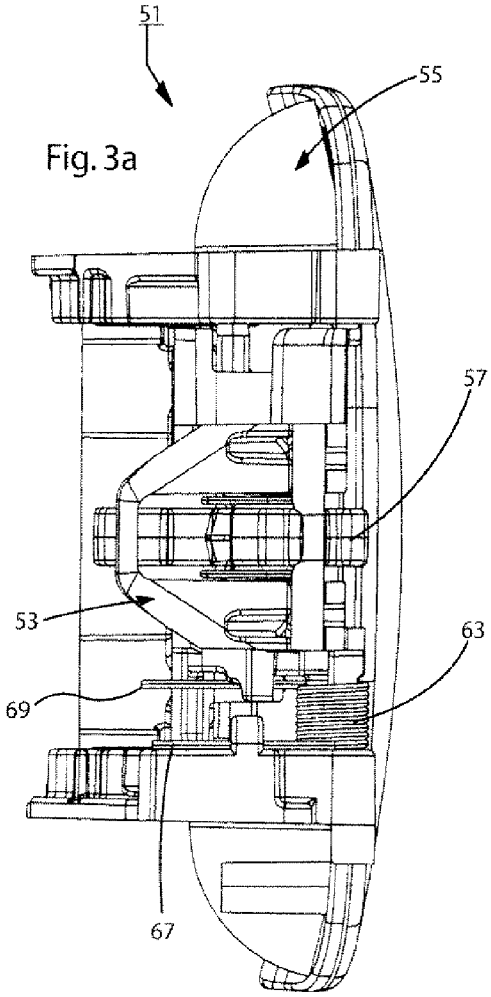
FIG. 3*a* is the striker engaging end view of the closed glove box latch assembly of FIG. 1.
Figure 3B:
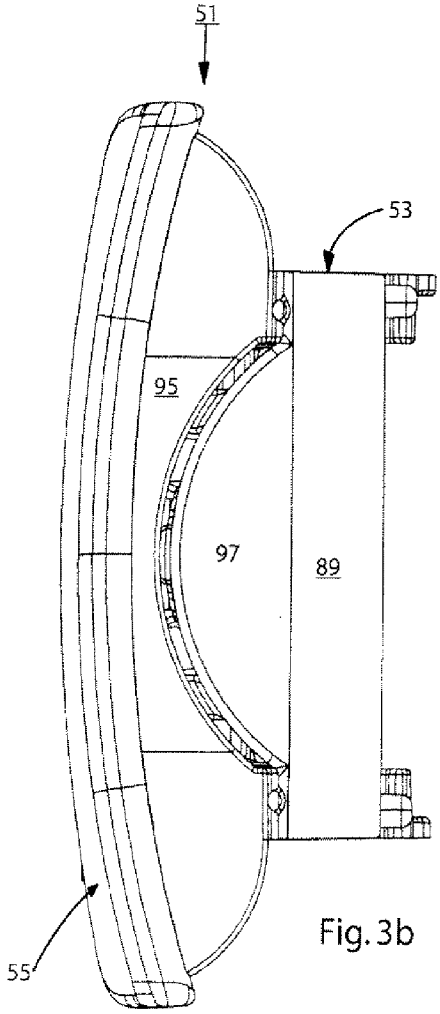
FIG. 3*b* is the handle/paddle end view of the closed glove box latch assembly of FIG. 1.
Figure 6:
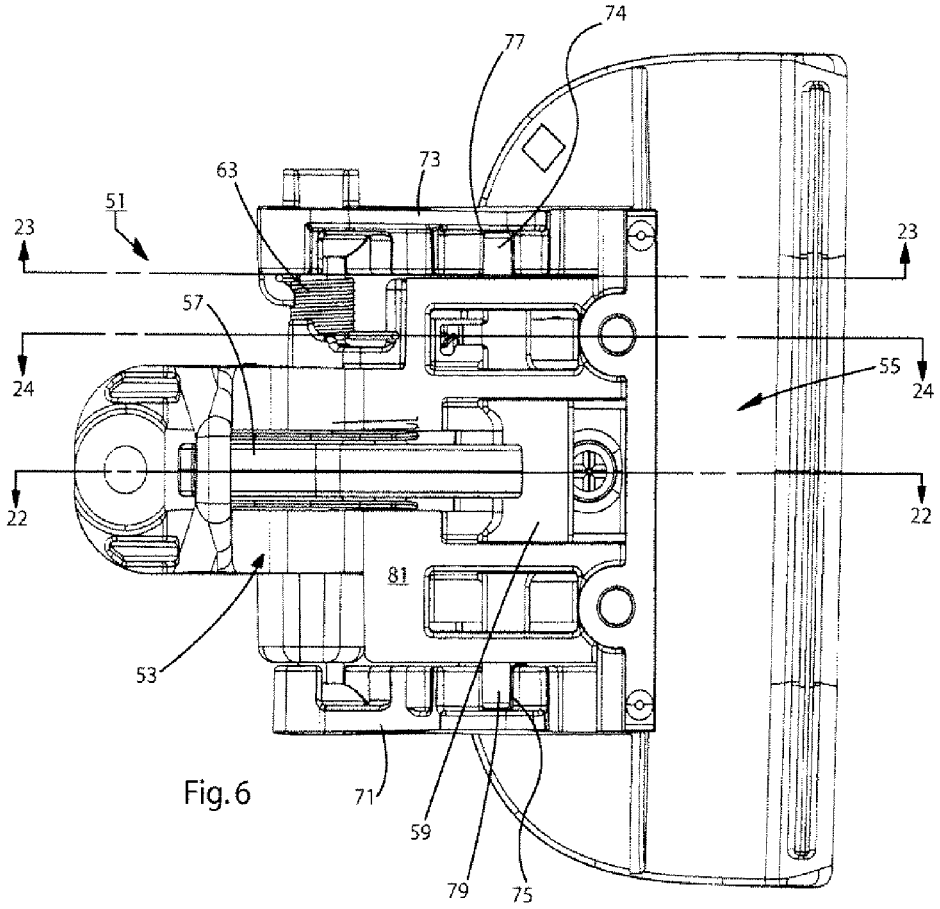
FIG. 6 is an inside, underside, plan view of the closed glove box latch assembly of FIG. 1.
Figure 9:
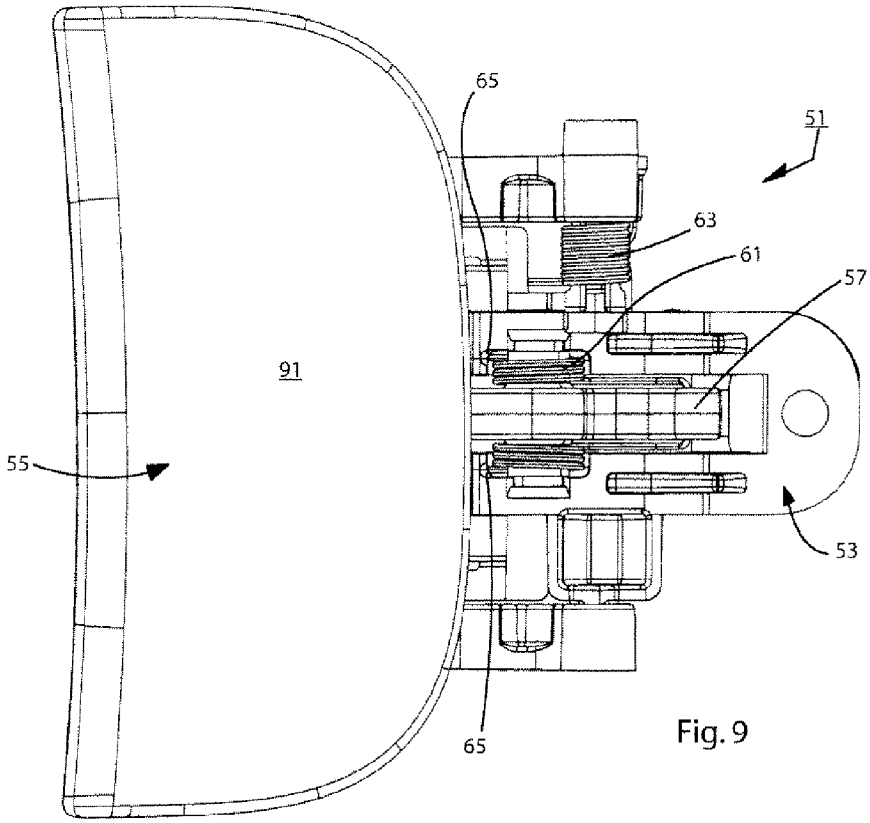
FIG. 9 is an outside plan view of the open glove box latch assembly of FIG. 7.
Figures 9A, 9B:
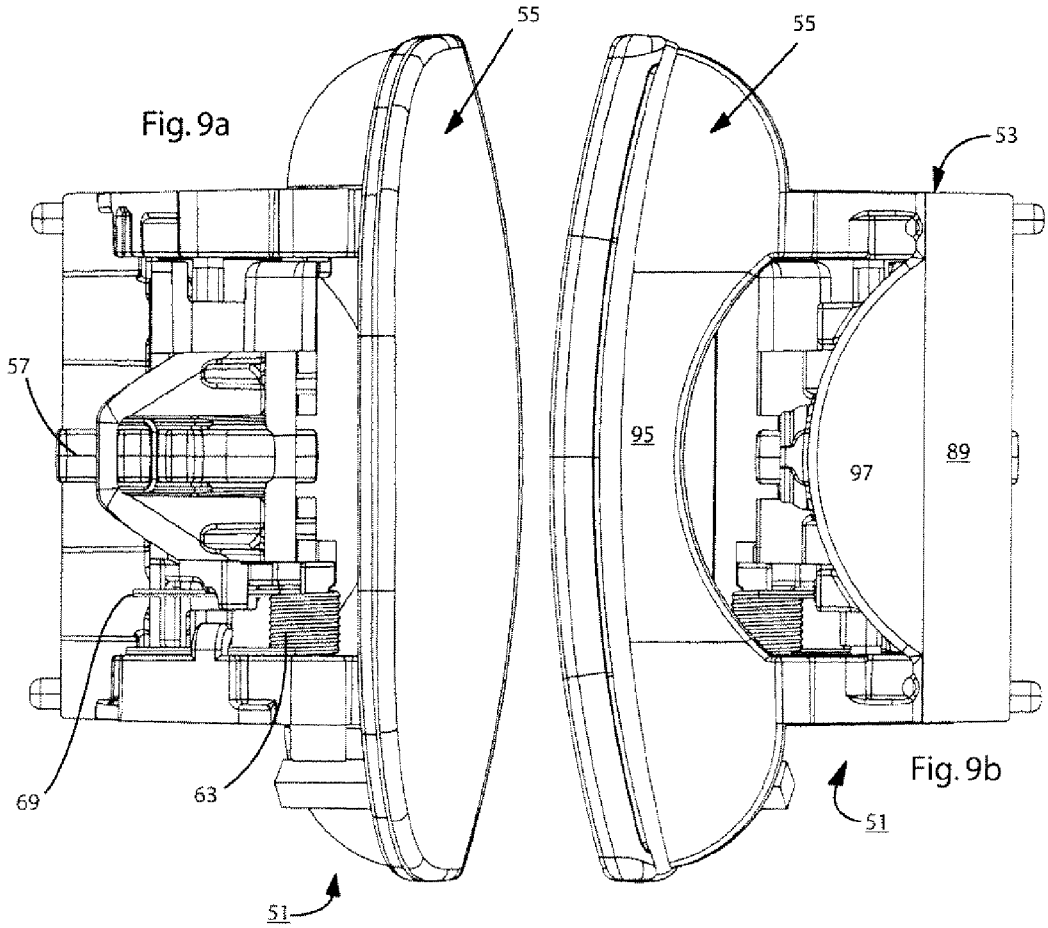
FIG. 9*a* is the striker engaging end view of the open glove box latch assembly of Fig, 7.
FIG. 9*b* is the handle/paddle end view of the open glove box latch assembly of FIG. 7.
Figure 12:
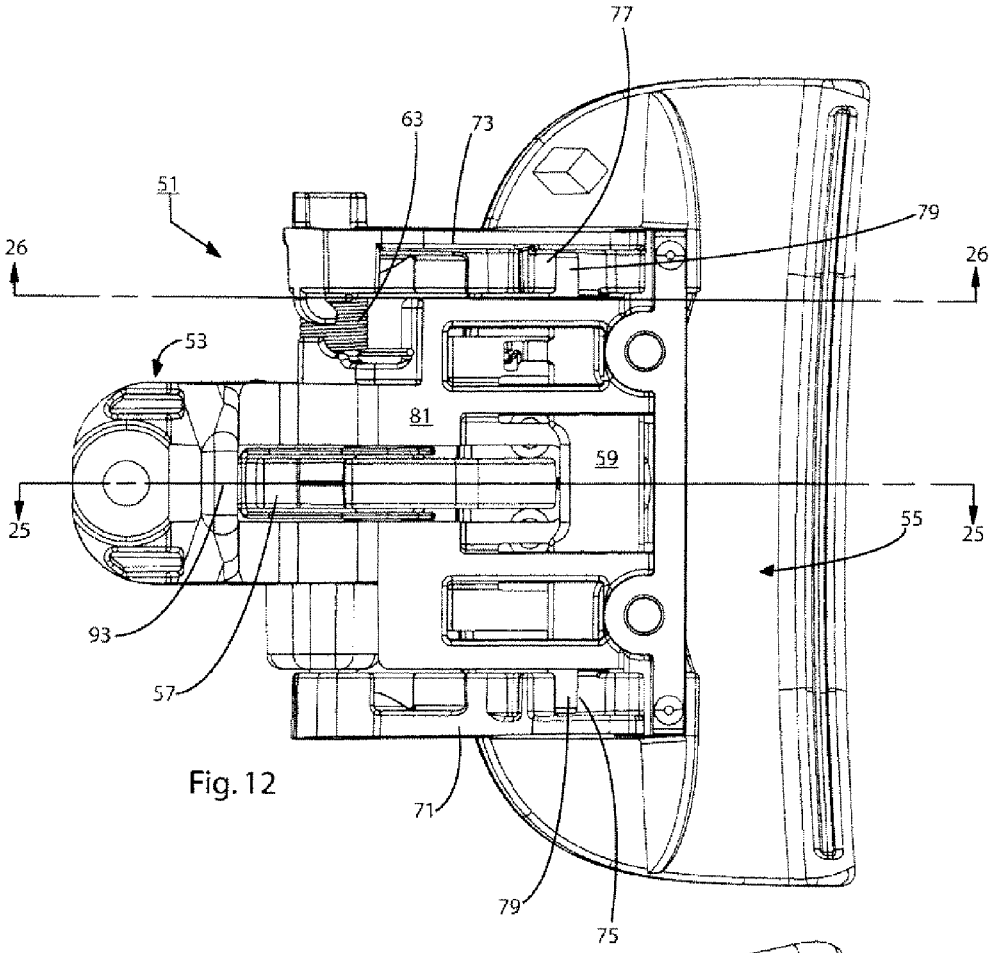
FIG. 12 is an inside plan view of the glove box latch assembly of FIG. 7.
Figure 11:
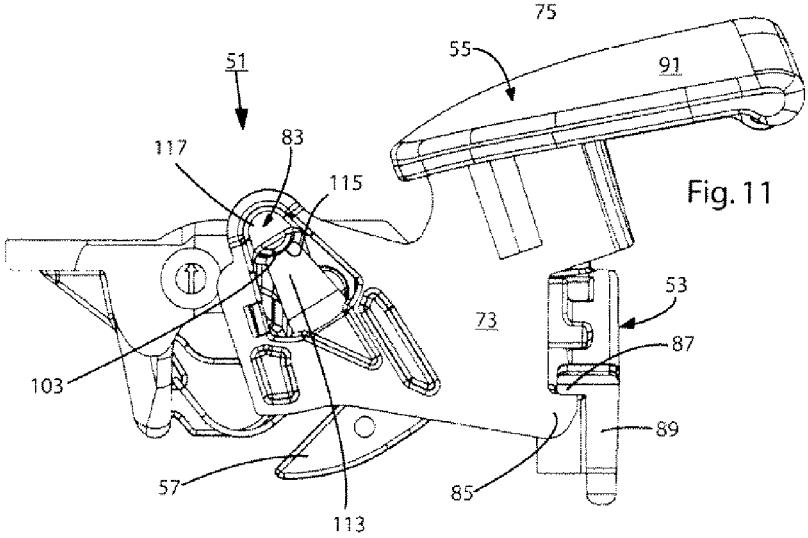
FIG. 11 is a left side view of the glove box latch assembly of FIG. 7.

The paddle structure 55 has a downward extending skirt 95, and the housing back wall 89 has an upward extending skirt 97, FIGS. 3*b* and 9*b*. The shape of these skirts 95, 97 is complementary so that the outside back end of the latch assembly 51 is closed-off when the paddle structure 55 is in the closed position, FIG. 3*b*. A pair of abutment tips 99 are positioned, one each, on either side of the housing 53 back wall 89 and act as stops for the return motion of the paddle structure 55 to the closed position. These abutment tips 99 contact the paddle skirt 95 bottom face, FIG. 3*b*, and keep the two skirts 95, 97 otherwise from being in full contact. This reduces noise and provides a positive "click" noise upon the latch closing.

Figure 13:
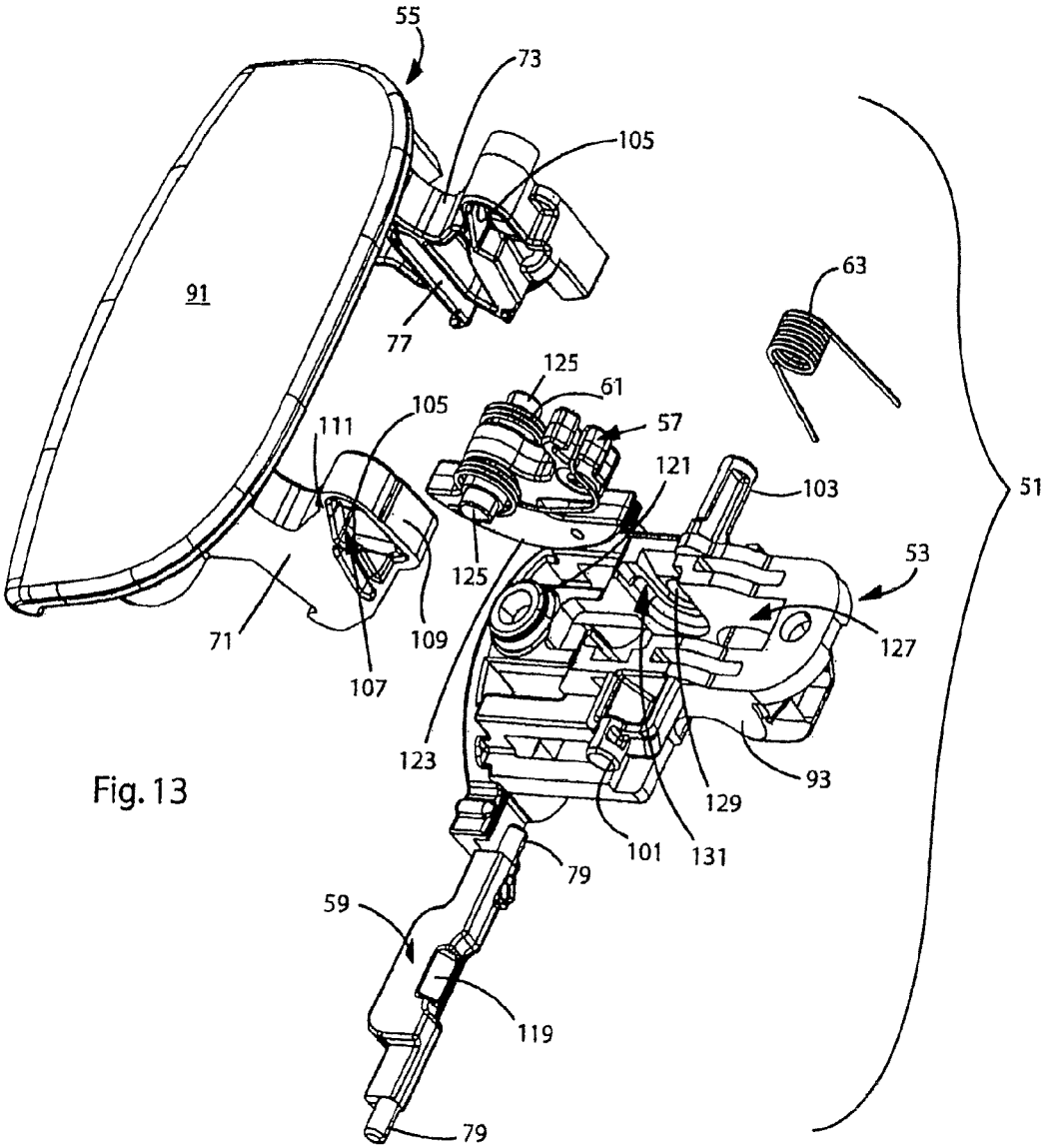
FIG. 13 is a perspective exploded view of the glove box latch assembly of the present invention.

While the paddle structure 55 pivots on the housing 53, FIG. 13, it is the housing 53 that carries a pair of stub shafts 101, 103 upon which the paddle 55 pivots as shown in the exploded assembly view, FIG. 13. The left side stub shaft 103 is longer to accommodate the mounting thereon of the paddle biasing spring 63.

The elongate lock plate 59 is bar-shaped with an end foot 79 at either end. These end feet 79 act as cam followers as the lock plate 59 is moved up or down the paddle side walls 71, 73, thereby riding in and extending between the guideways 75, 77.

The two parallel extending side walls 71, 73 of the paddle structure 55 provide a strong structure. Each paddle side wall 71, 73 terminates in an almost semi-circular journal member 105, FIGS. 2 and 8. Each of these journal members 105 forms the top corner of a triangular-like opening 107 formed by tangentially meeting walls 109, 111, FIGS. 1, 7 and 13. A living spring, i.e., inward tilted finger 113, extends into the triangular opening 107, FIGS. 4, 5, 10, 11. The end of each tilted finger 113 is curved 115. This curve 115 completes the journal surface with the member 105.

The end of each paddle journal member 105 is capped 117, FIGS. 4, 5, 10 and 11, to retain the position of the end of a respective stub shaft 101, 103. The housing 53, in addition to the abutment tips 99, has a ring-shaped bumper 121, FIG. 13, which abuts the inward face of the gripping plate 91 when the paddle structure 55 is in its fully closed position.

The lock plate 59 has a tapered surface 119 which rides along the rear edge face 123, FIG. 13, of the pawl 57 and to engage the pawl 57 in the interference-friction "locking" position. The pawl 57 has a pair stub shafts 125, one on either side, on which is rotates. The pawl biasing spring 61 is assembled on the stub shafts 125 with its end legs 65 facing away from the striker engaging end of the pawl 57. The pawl 57 operates in a cavity 127 in the housing 53 with each stub shaft 125 pivoting in a respective pivot hole 129 through the wall of the housing positioned in a spring cavity 131, FIGS. 13 and 14, in each juxtaposed side wail of the pawl cavity 127.

The pawl biasing spring 61 is assembled on the pawl 57 and the pawl is forced into the pawl cavity 127 of the housing 53. The inner face of the outside wall of each spring cavity 131 has a slight inward taper 133 leading into the pivot hole 129. This taper 133, FIG. 14, causes the walls of the spring cavity 131 to spread apart as the pawl 57 pivot shafts 125 are moved downward into the cavities 131. The pivot shafts 125 then snap into the respective pivot holes 123 and the pawl 57 is installed. As the pawl 57 carrying its biasing spring 61 is moved downward into the cavities 131, the end legs 65 of the spring 61 are forced into a vertical position by the rear walls of the cavities 131. This places a positive tension on the pawl biasing spring 61, FIG. 15.

Figures 14, 15:
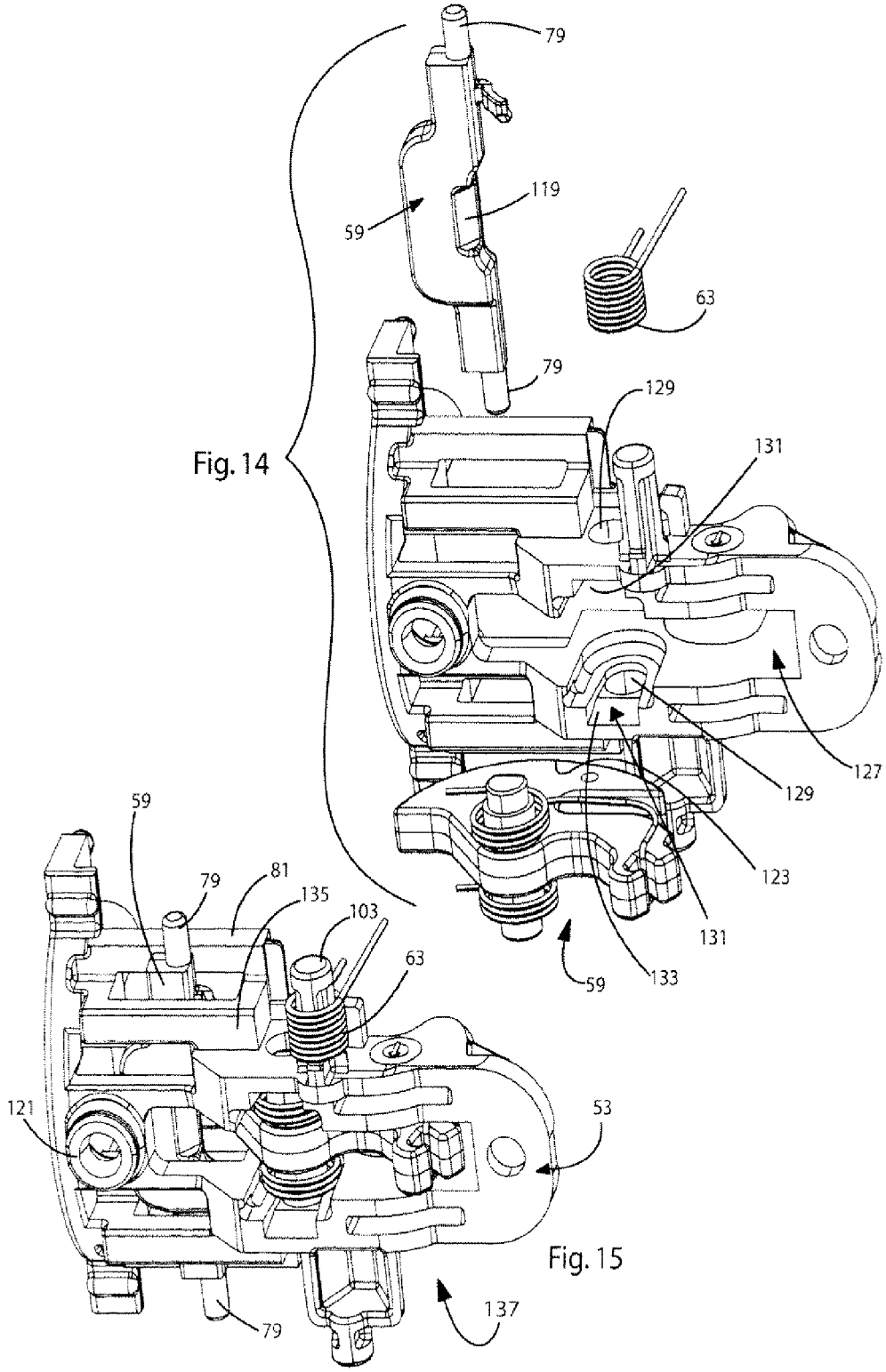
FIG. 14 is a perspective exploded view of the housing sub-assembly of the glove box latch of the present invention.
FIG. 15 is a perspective inside view of the assembled housing sub-assembly of FIG. 14.
Figure 16:
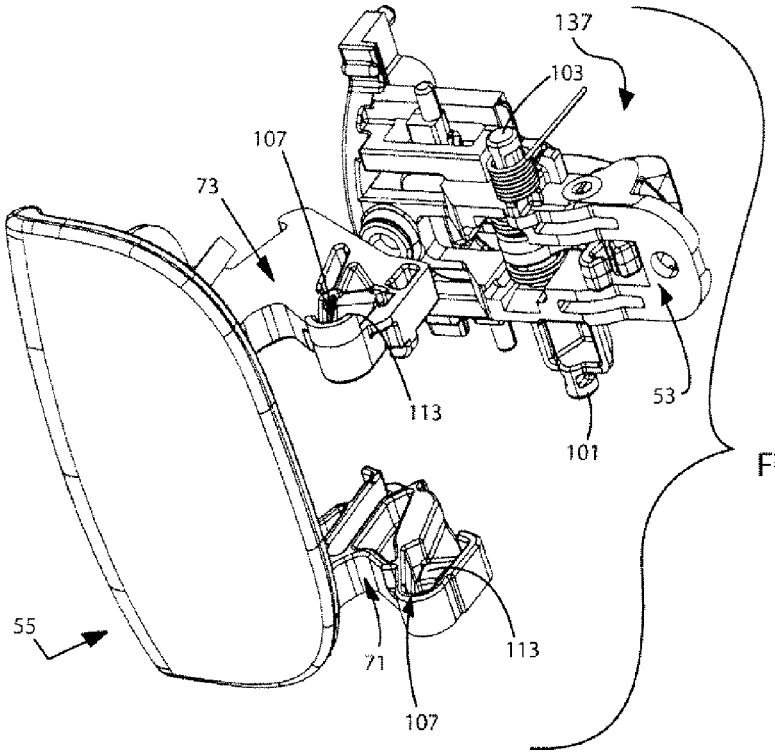
FIG. 16 is a perspective exploded view of the housing sub-assembly and the paddle.
Figure 17:
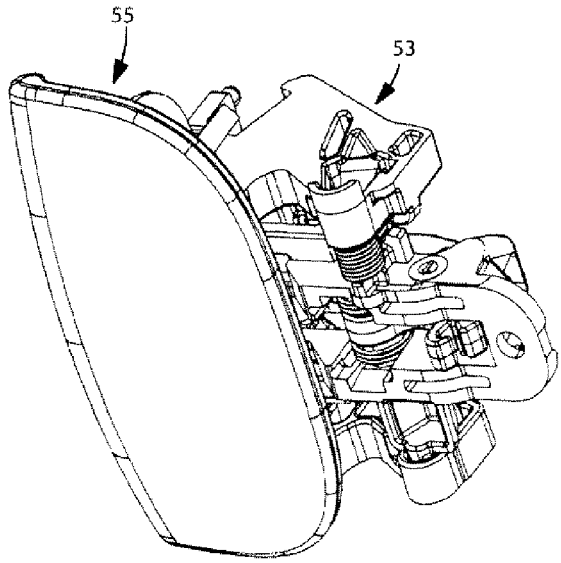
FIG. 17 is a perspective view of the glove box latch assembly of the present invention after the paddle is snapped onto the housing sub-assembly.

The housing sub-assembly, FIGS. 14 and 15, can be assembled by hand i.e., manually. The further assembly includes the mounting of the paddle biasing spring 63 on the longer housing stub shaft 103, and the sliding of the locking plate 59 into the housing 53 between the bottom wall 81 thereof and the housing top wall 135, FIG. 15. The housing sub-assembly 137 is then complete, FIG. 15. The paddle structure 55 is then forced down onto the housing sub-assembly 137, FIG. 16. In doing so, the triangular openings 107 of each paddle structure side wall 71, 73, passes over the sub shafts 101, 103 of the housing 53 and each respective living spring finger 113 is spread outwardly until the shafts 101, 103 are clear. The shafts 101 and 103 then snap inwardly and each stub shaft 101, 103 is held by the end caps 117 and the journal surfaces 105 securely in place against the living spring curved surfaces 115. Each living spring 113 exerts a pressure against a respective pawl stub shafts 101, 103 to dampen vibrations. The paddle structure 55 is free to pivot on the housing 53 between open and closed positions.

If the pivot point 83 were below the top edge of the paddle 55, any portion of the paddle structure 55 above this point 83 will rotate in, towards the glove box door 139 surface, and therefore a clearance gap would be required between the top and side edges of the paddle, and the glove box door 139 as only the portion of the paddle 55 below the pivot point would rotate away from the glove box door 139 surface.

The paddle side wails 71, 73 establish a raised goose neck pivot point 83 for the paddle structure and its gripping plate 91. When actuated, the paddle 55 and its gripping plate 91, have a raised pivot point, and rotate away from the glove box door 139 surface. The raised pivot point 83 of the present latch assembly 51 means that the whole paddle 55 is below the pivot point 83 and hence the whole paddle 55 rotates away from the glove box door 139 surface reducing the required clearance.

Figure 18:
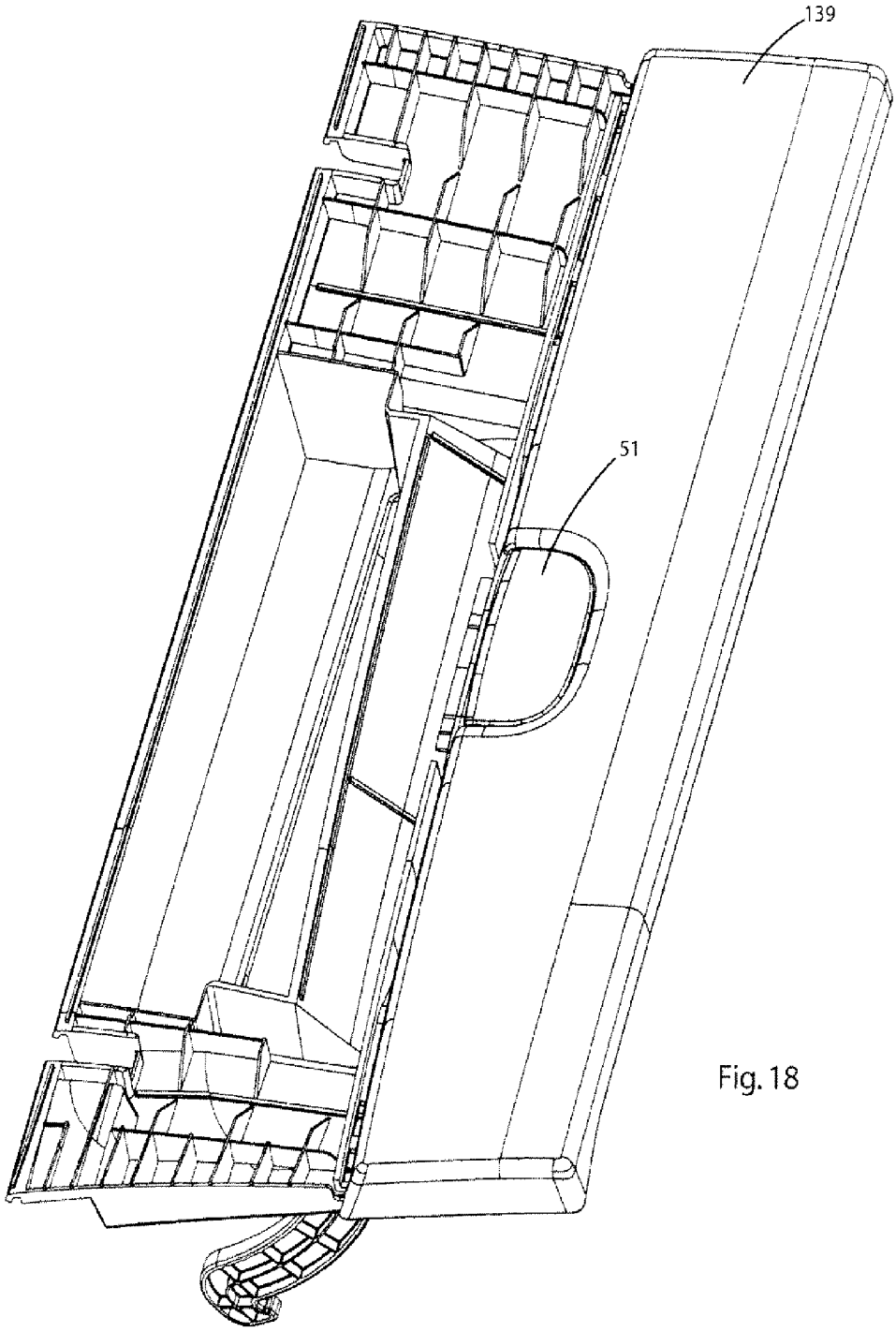
FIG. 18 is a perspective outside view of the glove box latch assembly in the closed position and mounted to a drop-open glove box door.
Figure 19:
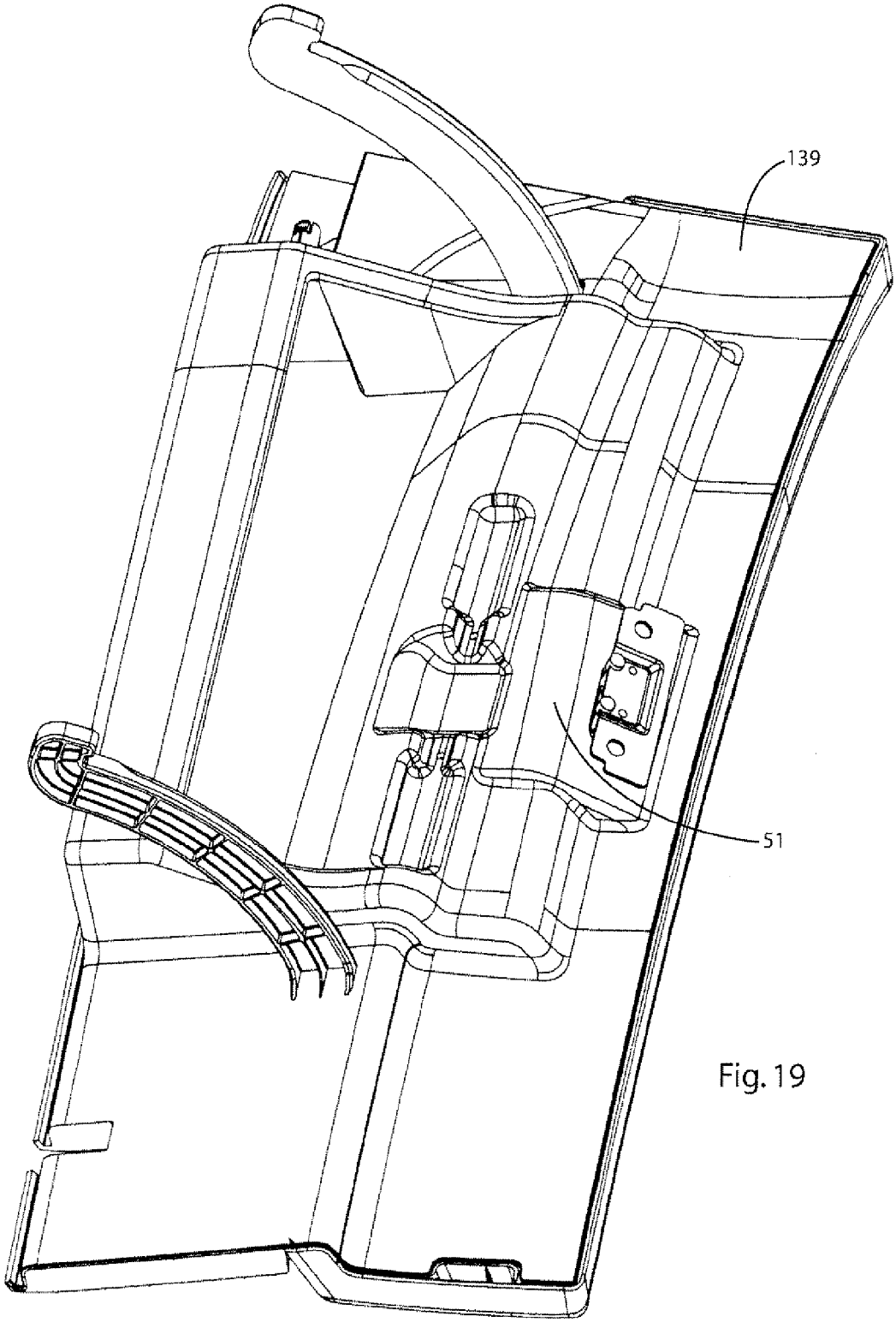
FIG. 19 is a perspective inside view of the glove box latch assembly and door of FIG. 18.
Figure 20:
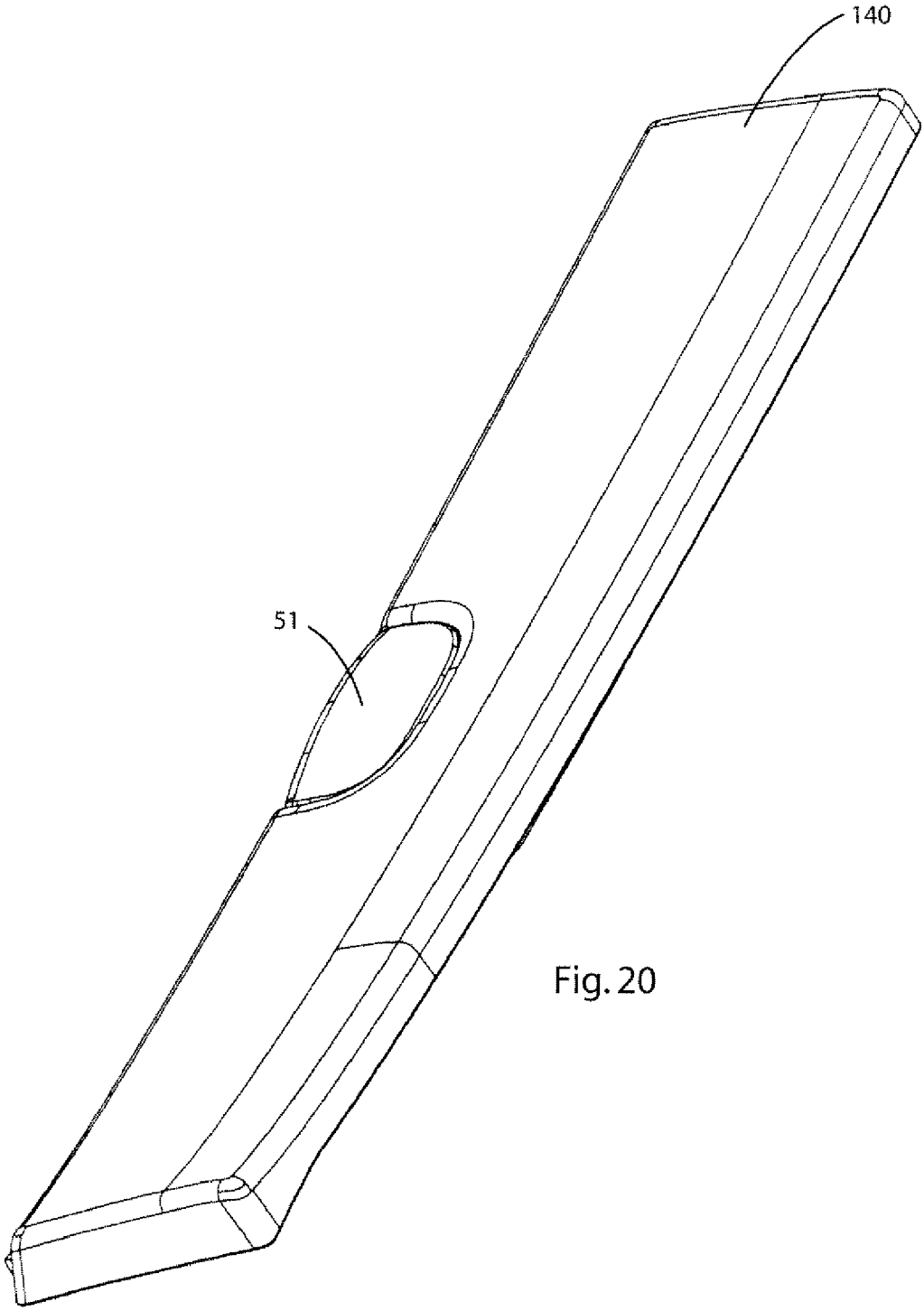
FIG. 20 is a perspective outside view of the glove box latch assembly in the closed position and mounted to a removable panel.
Figure 21:
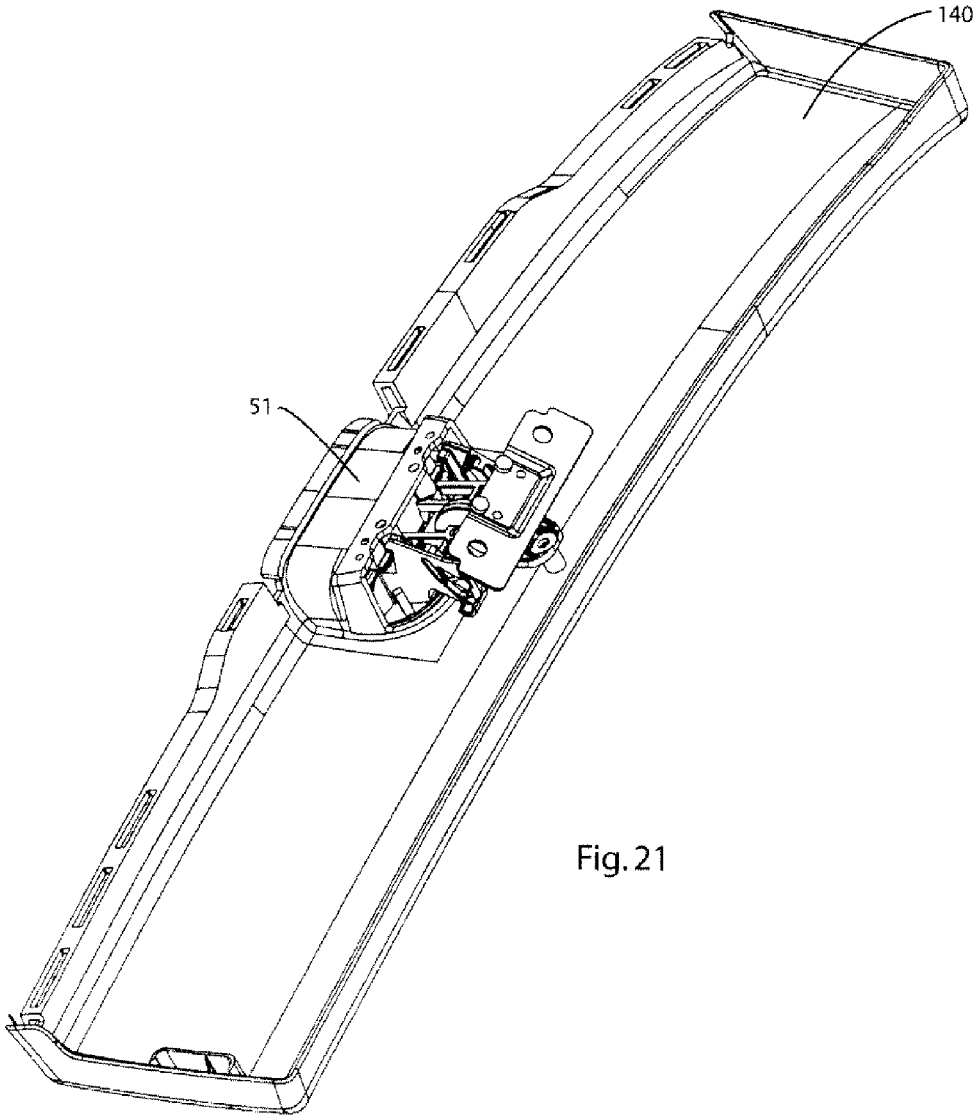
FIG. 21 is a perspective inside view of the glove box latch assembly and panel of FIG. 20.

FIGS. 18 and 19 show the attachment of the present raised pivot point latch assembly 51 mounted to a door panel 139, and the reduced clearances necessary for operation. FIGS. 20 and 21 show the latch assembly 51 mounted to a removable panel. These figures illustrate the reduced envelope of the latch assembly 51.

Figure 22:
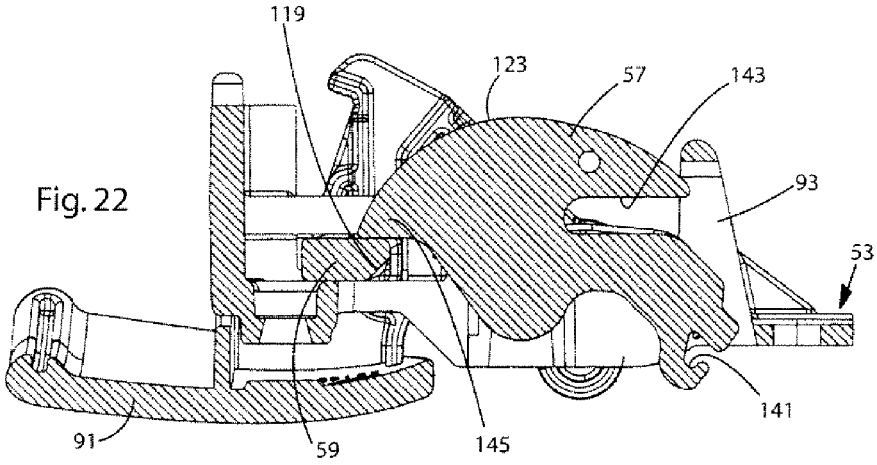
FIG. 22 is a cross-sectional view of the glove box latch assembly in the closed position and taken through the rotary pawl as shown in FIG. 6.

The rotary pawl 57 is claw-shaped, FIG. 22, having a biasing spring slot 141, a striker wire engaging slot 143, and a rear catch finger 145. In the closed position, FIG. 22, the rear catch finger 145 of the pawl 57 overlaps the lock plate 59 to abut it on one face (upper surface 157) thereof, and holds the pawl's striker engaging slot 143 into the hook-shaped member of the housing 53 for engagement with a wire striker 151. Raising the paddle gripping plate 91 causes paddle structure 55 to rotate, which moves the lock plate 59 away, outward from abutment contact with the pawl rear catch finger 145 and behind it so that the pawl 57 is free to rotate to the open position, FIG. 25 wherein the curved rear edge 123 of the pawl 57 engages an opposite surface (face) of the lock plate 59, that being a tapered surface 119 on an opposite face.

Figure 23:
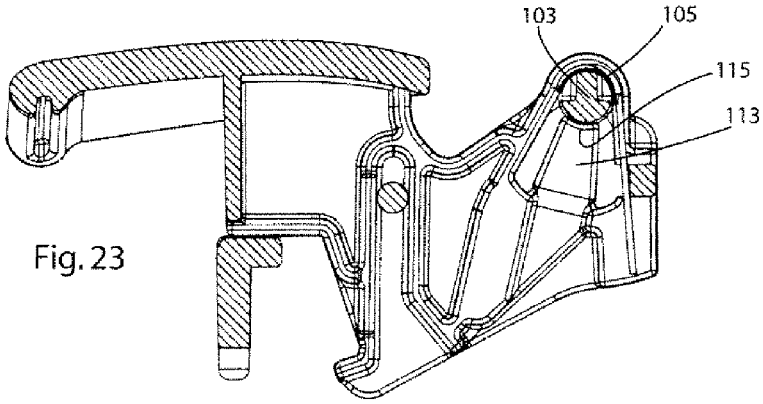
FIG. 23 is a cross-sectional view of the glove box latch assembly in the closed position and taken through the rotary pawl axel mounting as shown in FIG. 6.
Figure 24:
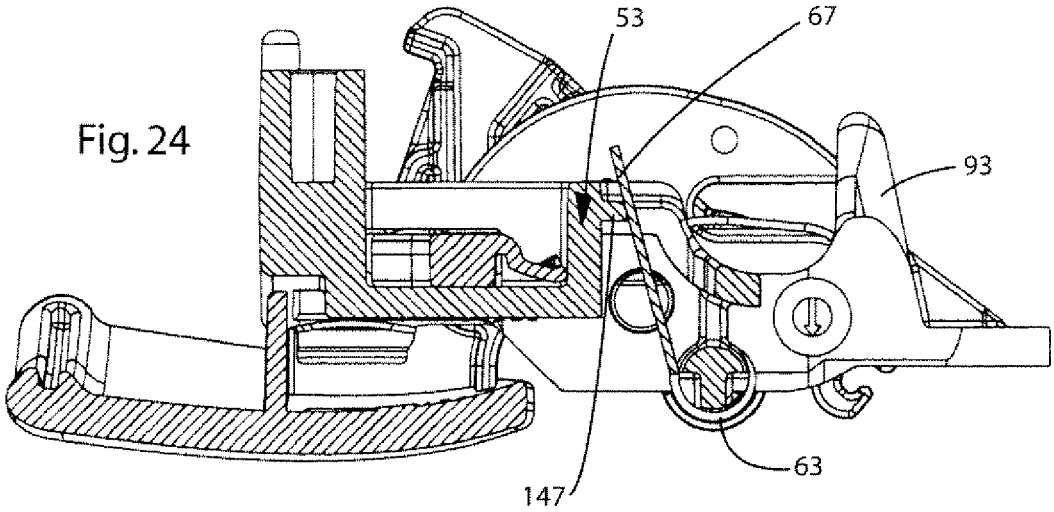
FIG. 24 is a cross-sectional view of the glove box latch assembly in the closed position and taken through a mid-point between the rotary pawl and the pawl axel mounting as shown in FIG. 6.

FIG. 23 shows a detail of the assembly and interaction of the housing pivot shaft 103, the journal surfaces 105, 115, and the living spring retention finger 113. FIG. 24 shows the interaction of the housing 53, the paddle biasing spring 63, its housing interacting end 67, which abuts a spring engagement member 147.

Figure 25:
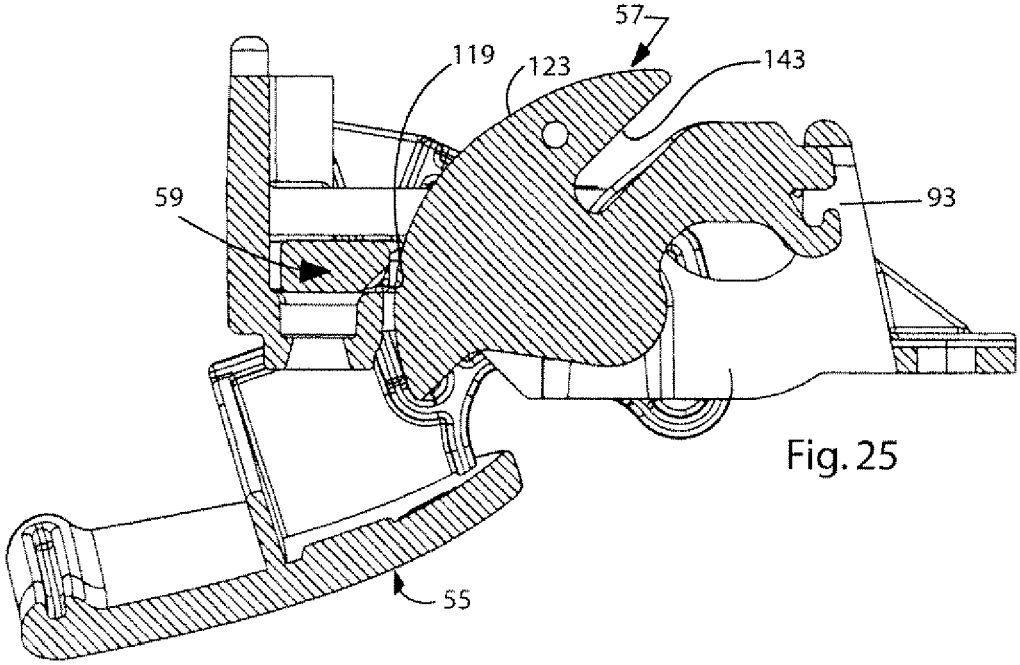
FIG. 25 is a cross-sectional view of the glove box latch assembly in the open position and taken through the rotary pawl as shown in FIG. 12.

FIG. 25 shows the paddle 55 held open by the interference-friction force of the lock plate 59 tapered surface 119 against the rear edge 123 of the rotary pawl 57. The paddle 55 wants to return to its closed position under the force of its torsion spring 63. This carries the lock plate tapered surface 119 into "friction contact" with the curved rear edge 123 of the pawl. This stops the movement of the lock plate 59 which in turn stops the movement of the paddle 55. Thereby the paddle 55 is held open.

When the latch assembly 51 is slammed to close, pressure is exerted against the paddle 55. The striker engagement slot 143 has rotated to the open position. The interference-friction force is developed by the increased tension in the paddle biasing torsion spring 63.

Figure 26:
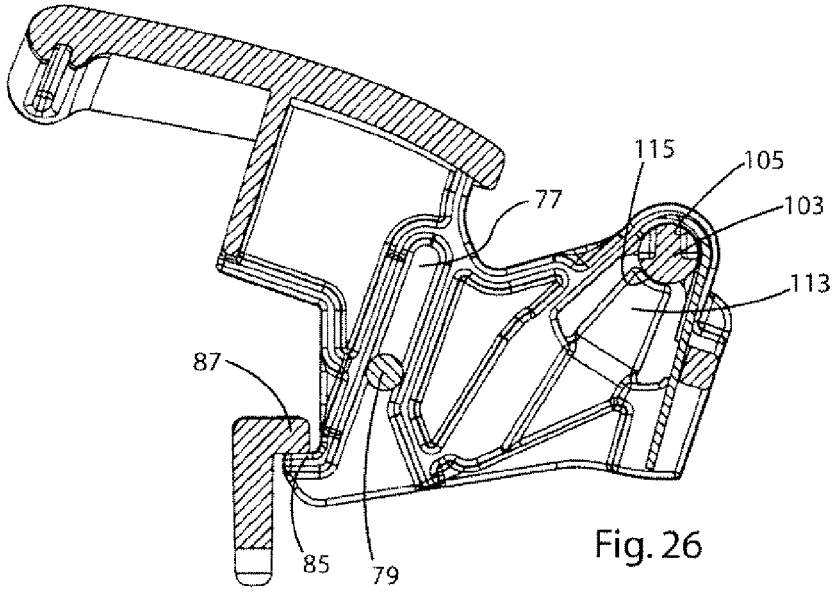
FIG. 26 is a cross-sectional view of the glove box latch assembly in the open position and taken through the rotary pawl axel mounting as shown in FIG. 12.

FIG. 26 shows the position of a lock plate end foot 79 in the paddle wall guideway 77 and the positive open position travel established by the abutment of the paddle wall finger 85 and the housing back wall projecting shoulder 87.

Figure 33:
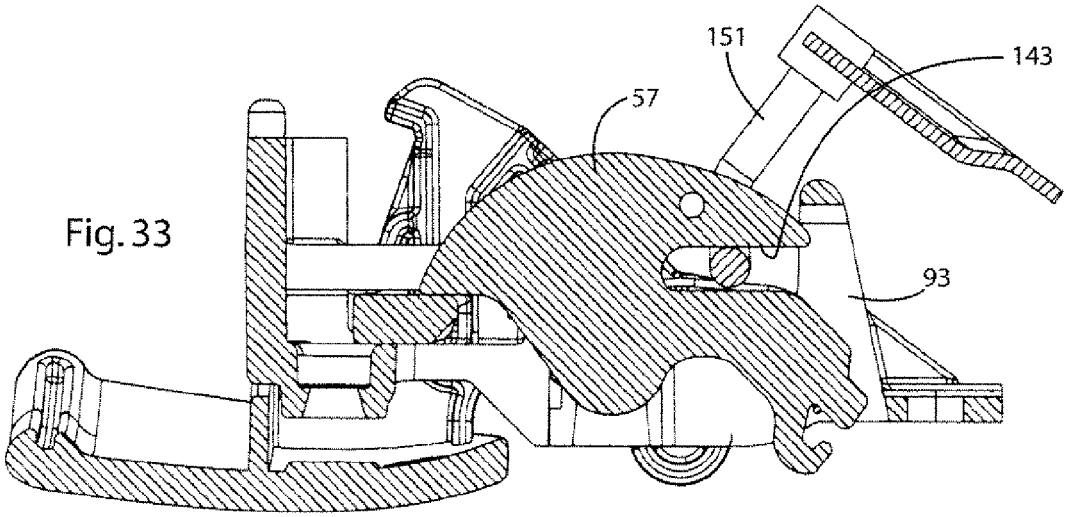
FIG. 33 is a cross-sectional view of the glove box latch assembly in the closed position and engaging the striker taken through the rotary pawl as shown in FIG. 32.
Figure 27:
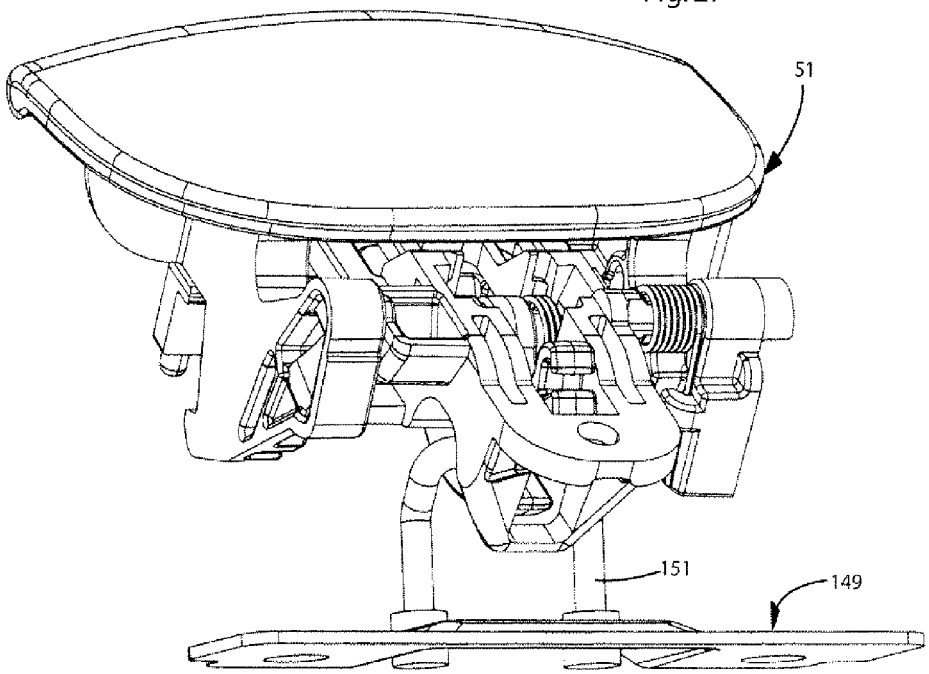
FIG. 27 is a perspective outside view of the glove box latch assembly in the closed position engaging a striker wire.
Figure 28:
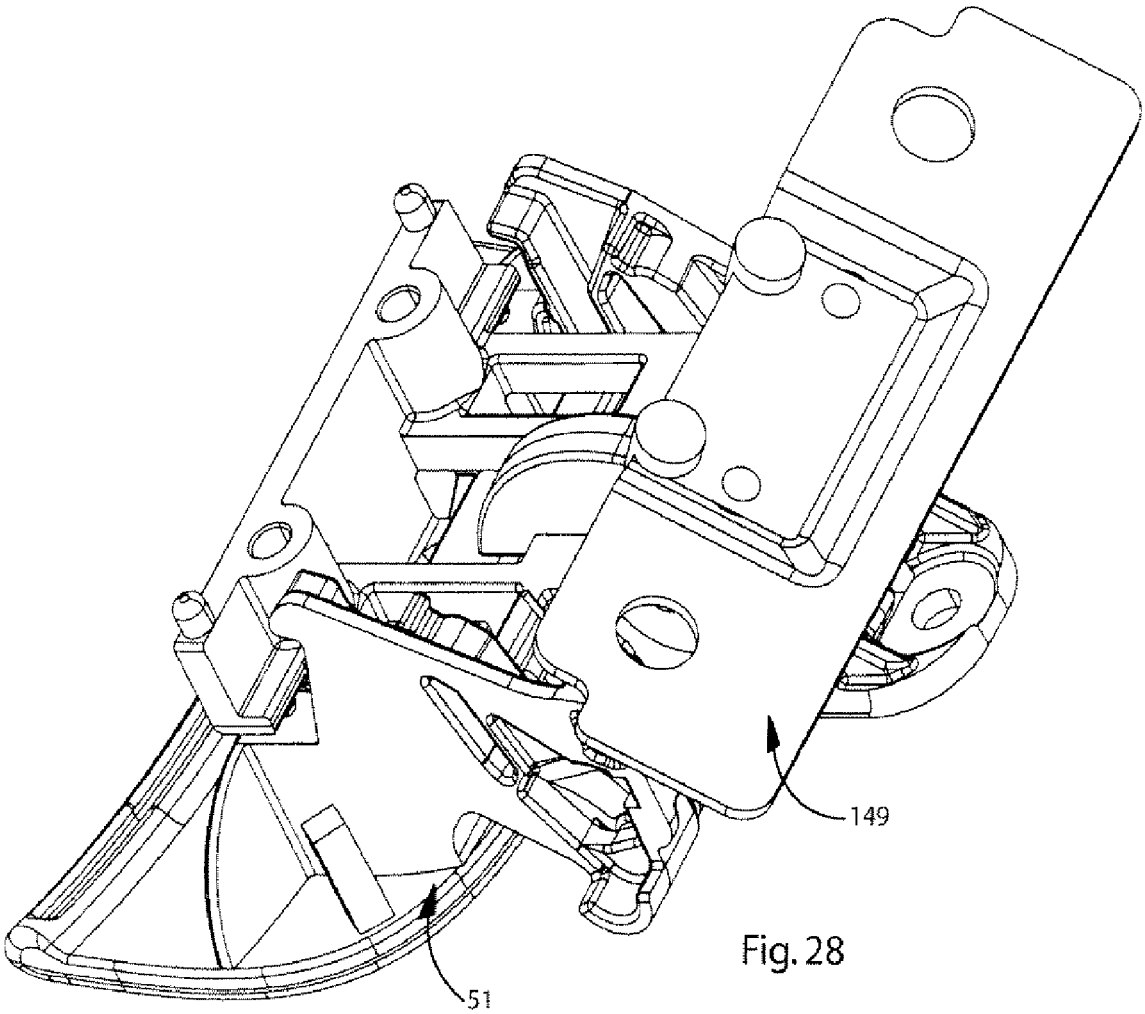
FIG. 28 is a perspective inside view of the glove box latch assembly in the closed position engaging the striker wire of FIG. 27.
Figure 29:
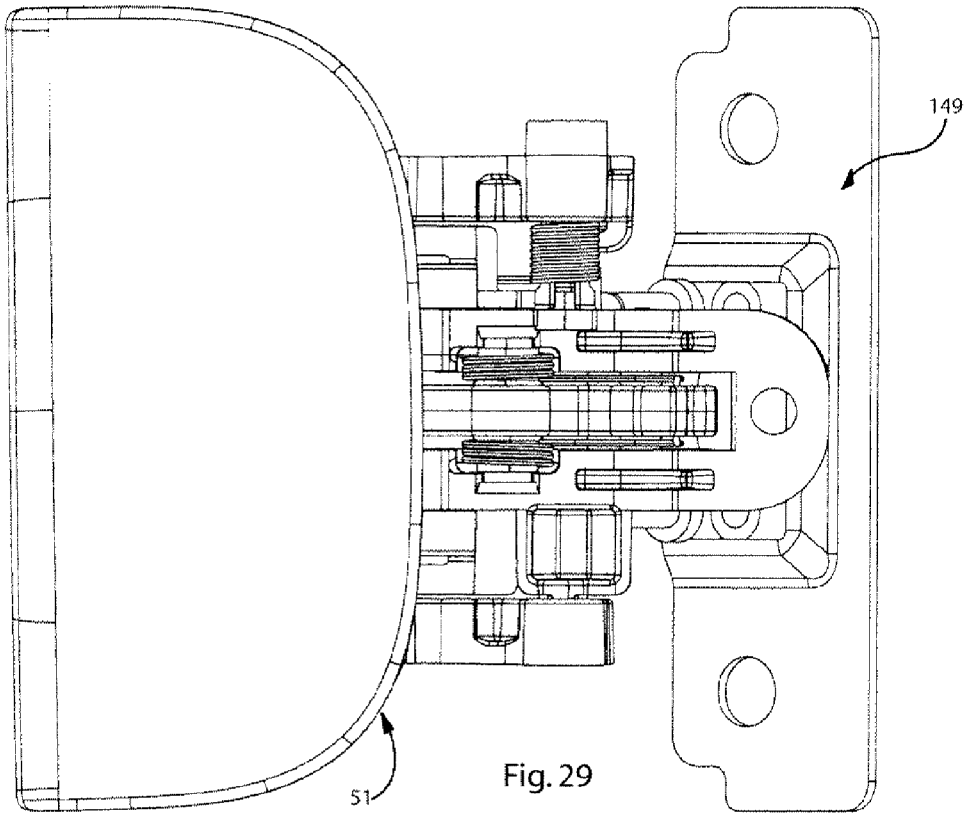
FIG. 29 is an outside, top, plan view of the closed glove box latch assembly and the striker of FIG. 27.
Figure 30:
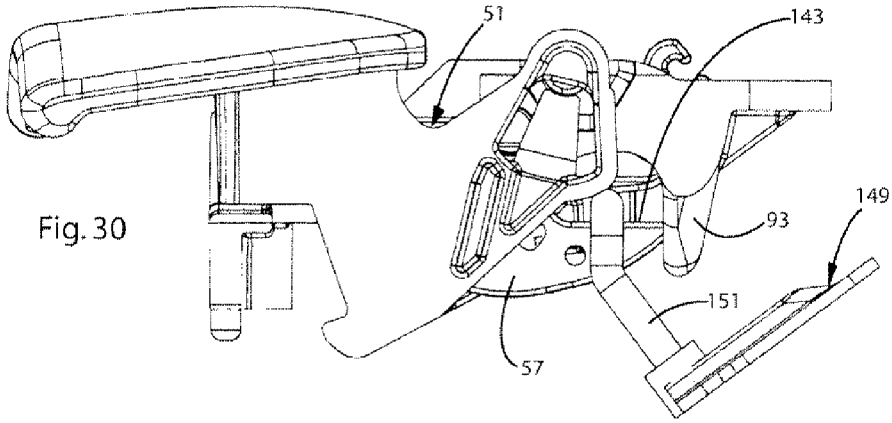
FIG. 30 is a right side view of the closed glove box latch assembly and the striker of FIG. 27.
Figure 32:
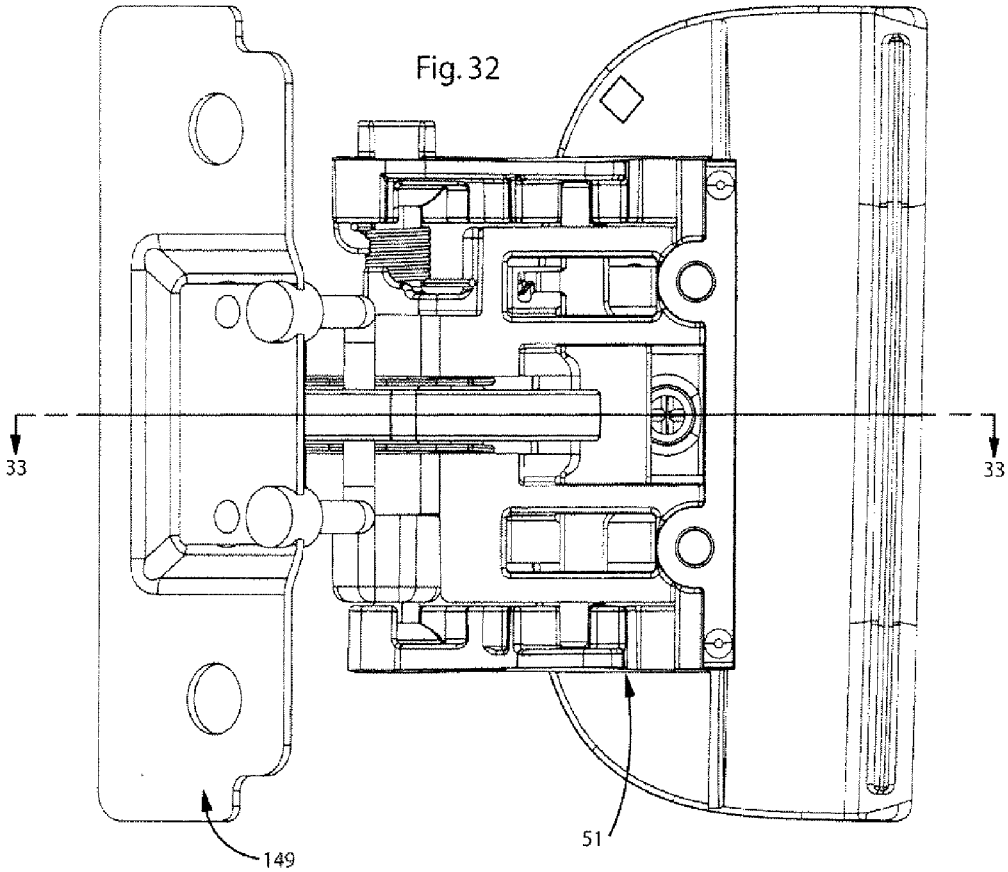
FIG. 32 is an inside, bottom, plan view of the closed glove box latch assembly and the striker.
Figure 31:
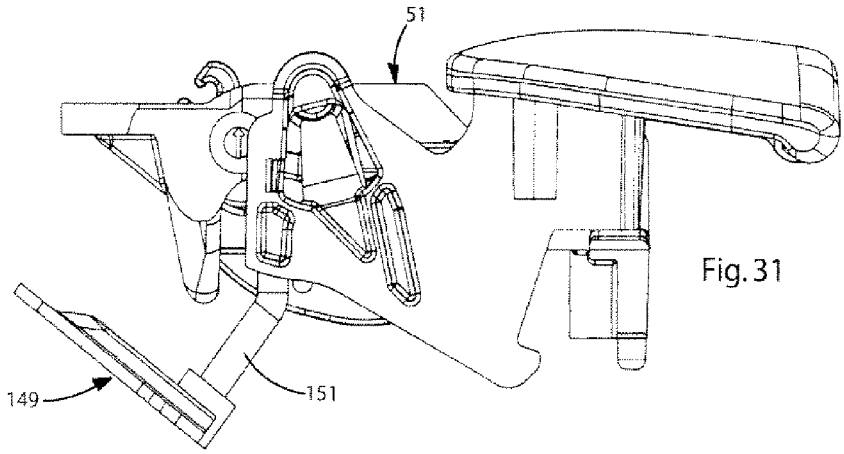
FIG. 31 is a left side view of the closed glove box latch assembly and the striker.

FIGS. 27-32 show views of the latch assembly 51 closed and in engagement with a striker assembly 149 having the wire striker 151, wherein the striker wire 151 is captured by the pawl 57 wire slot 143. FIG. 33 is similar to FIG. 24. However, in FIG. 33 the wire striker 151 is shown captured by the slot 143 of the pawl 57.

Figure 34:
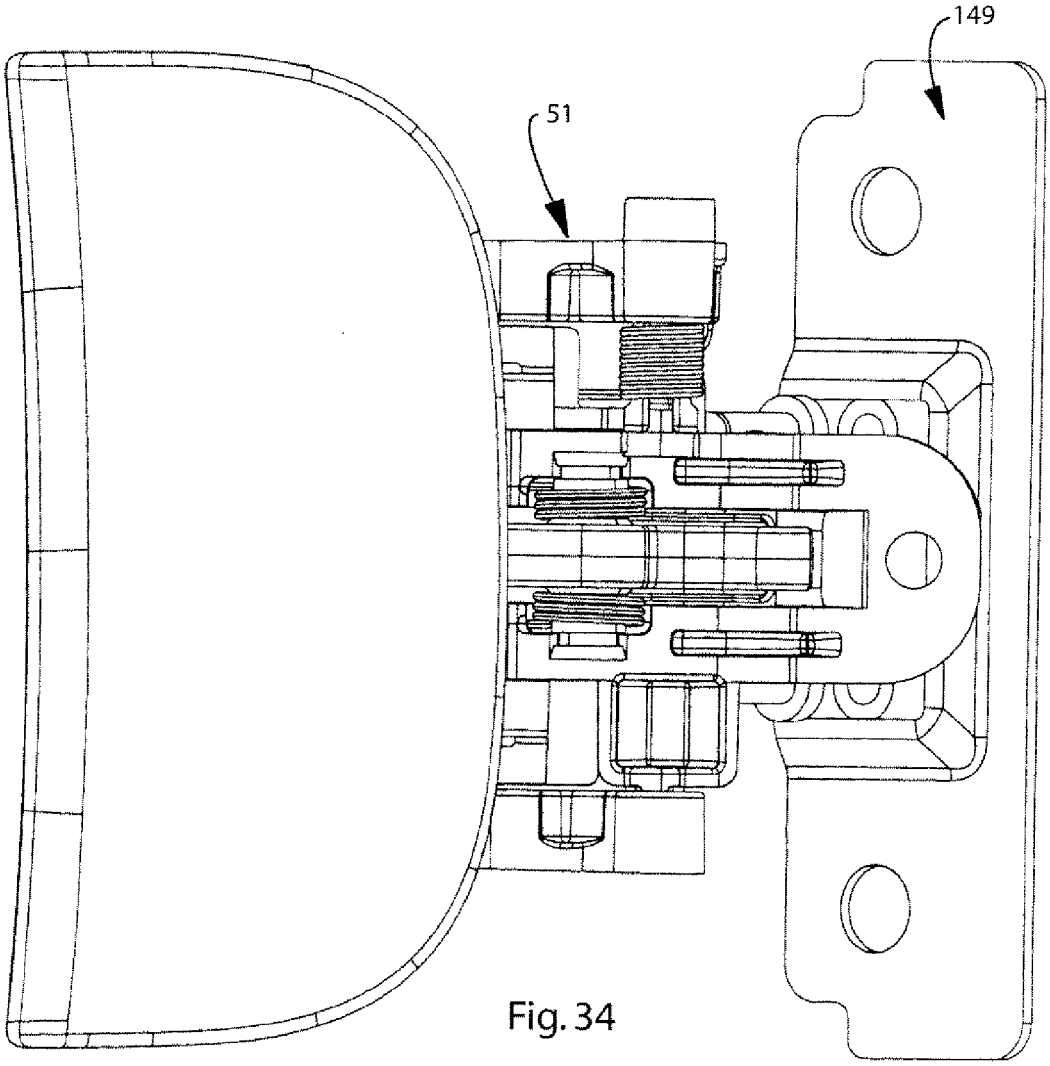
FIG. 34 is an outside, top, plan view of the open glove box latch assembly and the striker.
Figure 35:
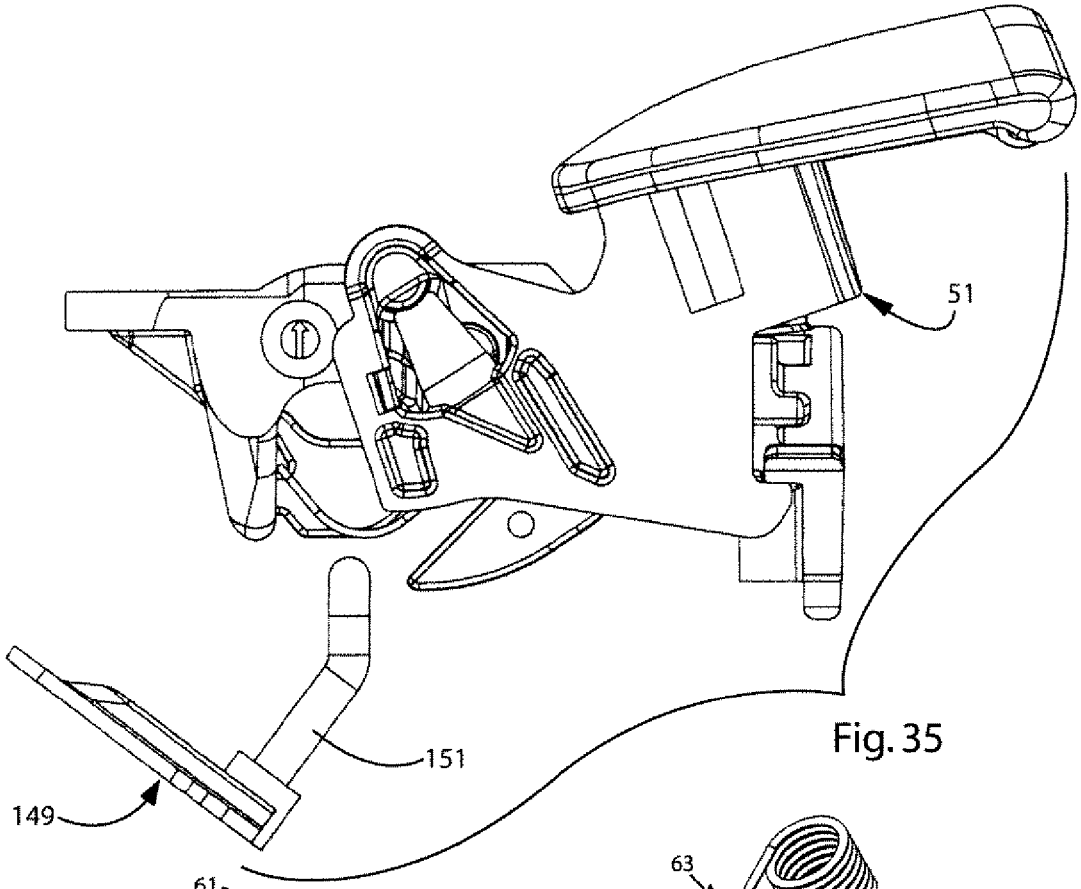
FIG. 35 is a left side view of the open glove box latch assembly and striker prior to engaging the striker.
Figure 36:
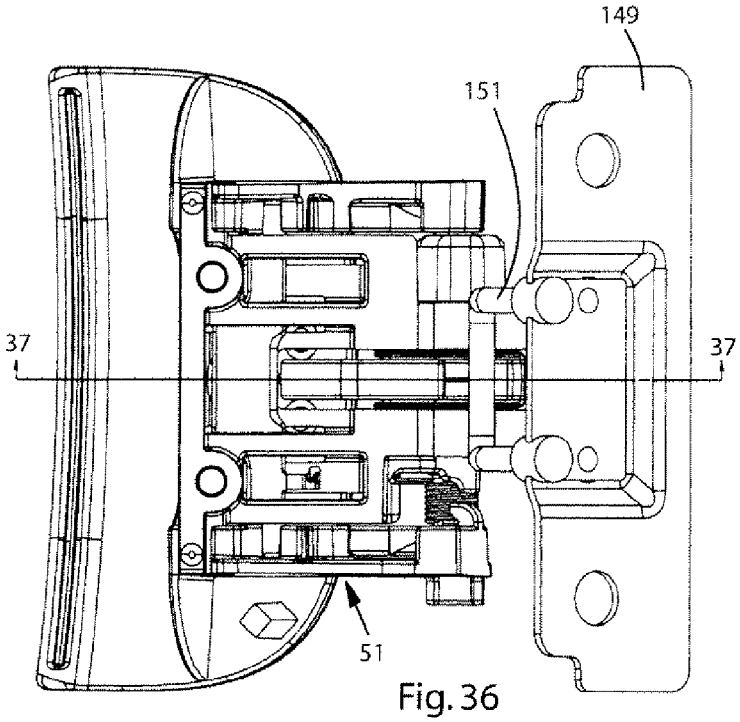
FIG. 36 is an inside, bottom, plan view of the open glove box latch assembly and the striker.
Figure 37:
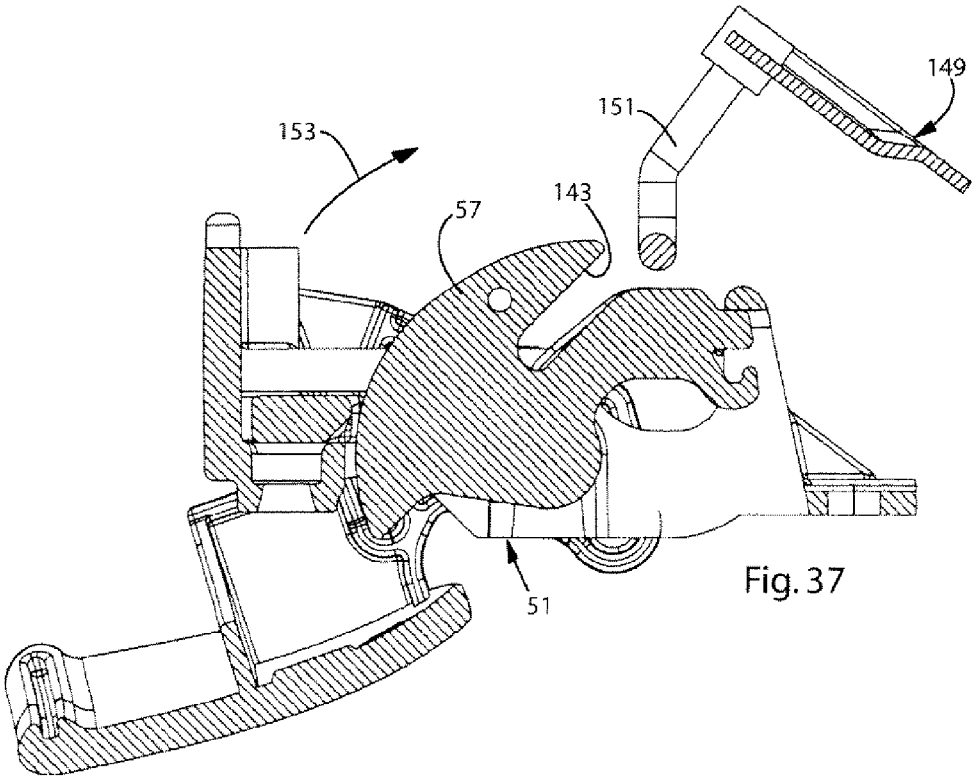
FIG. 37 is a cross-sectional view of the glove box latch assembly in the open position prior to engaging the striker taken through the rotary pawl as shown in FIG. 36.
Figure 39E:
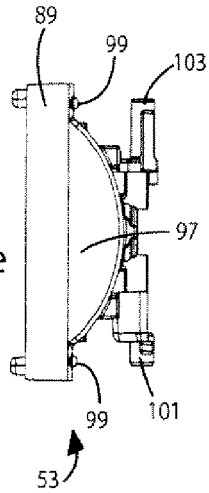
FIGS. 39*a* through 39*e* are perspective, top plan, side and end views of the housing member.
Figure 39C:
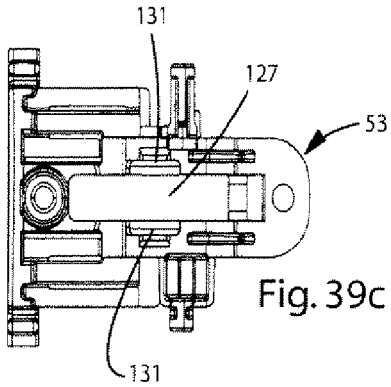
Figure 39D:
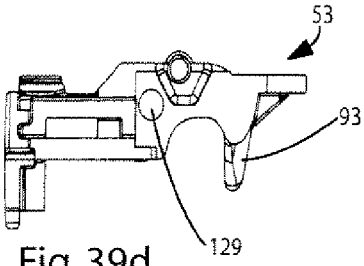
Figure 39A:
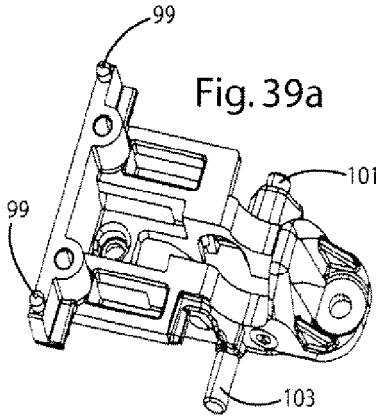
Figure 39B:
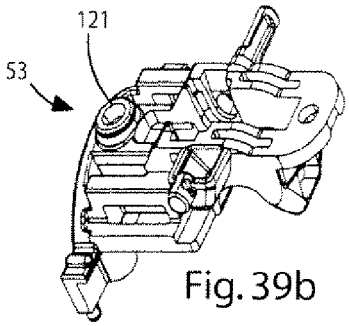
Figure 40D:
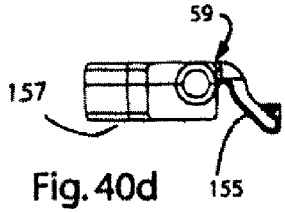
FIGS. 40*a* through 40*d* are perspective, top plan and side views of the lock plate member.
Figure 40C:
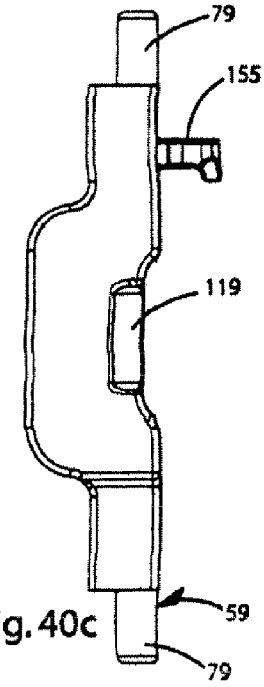
Figure 40B:
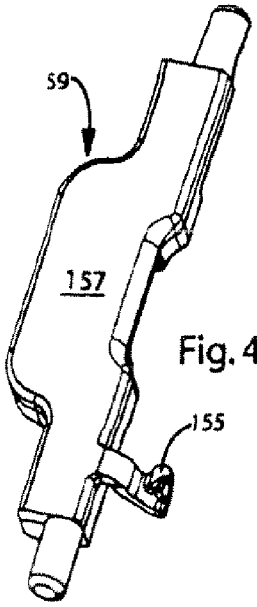
Figure 40A:
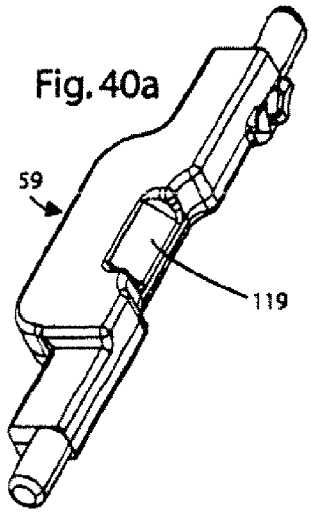

FIGS. 34-36 show views of the latch assembly 51 in the open position and prior to engagement with the striker wire 151. When the latch assembly is pushed into the striker wire 151, the pawl 57 is forced to rotate and closes the latch. FIG. 37 is similar to FIG. 25. However, in FIG. 37 the latch is positioned to move into the striker wire 151 when pushed to close, i.e., slam to close, according to the motion arrow 153.

FIGS. 38*a*-38*e* show perspective, top plan, left side, and right side views of the paddle structure 55. FIGS. 39*a*-39*e* show perspective, top plan, side and end views of the housing member 53.

FIGS. 40*a*-40*d* show perspective, top plan, and side views of the lock plate 59. Shown also in these views is a movement arm 155 (leg) co-acting with an engagement member in the side wall 73 of the paddle structure 55 which assures that the lock plate 59 moves with the pivotal movement of the paddle 55.

Figure 41B:
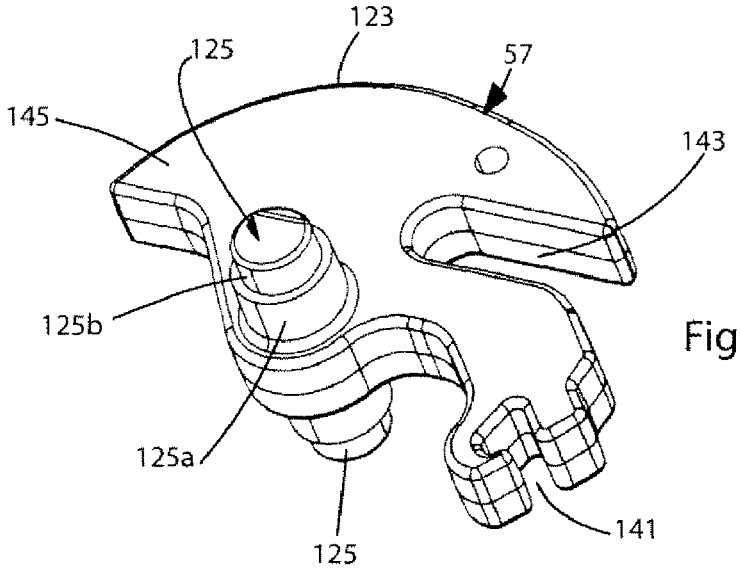
FIGS. 41*a* through 41*c* are views of the rotary pawl member and the pawl biasing spring member sub-assembly shown assembled and individually unassembled.
Figure 41C:
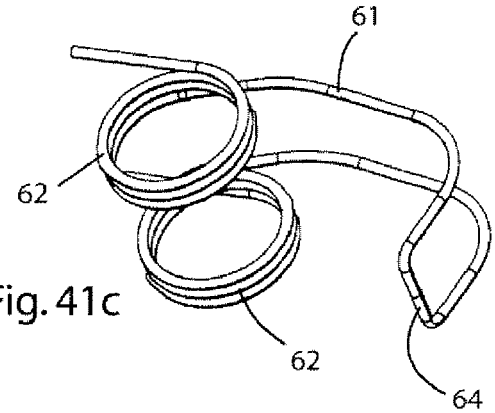
Figure 41A:
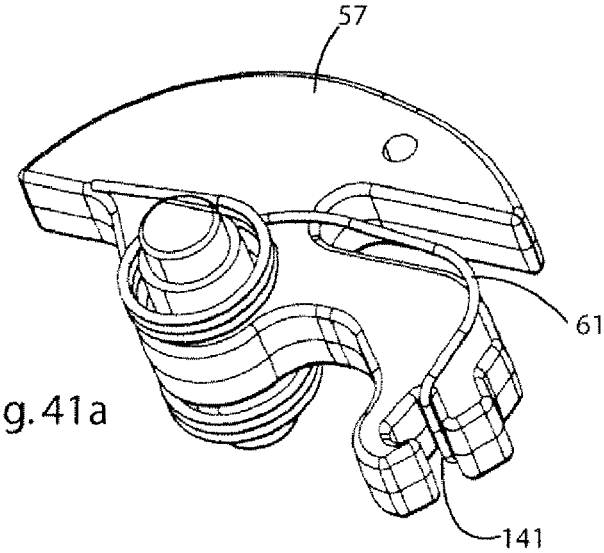
Figure 42C:
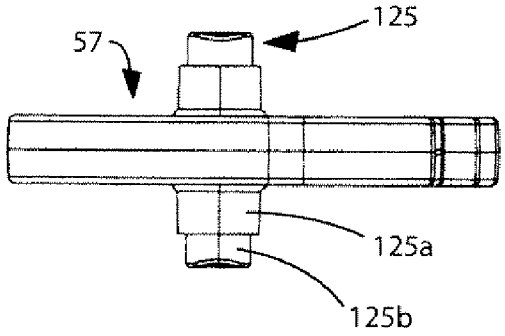
FIGS. 42*a* through 42*d* are left and right side views and top and bottom plan views of the rotary pawl member.
Figure 42A:
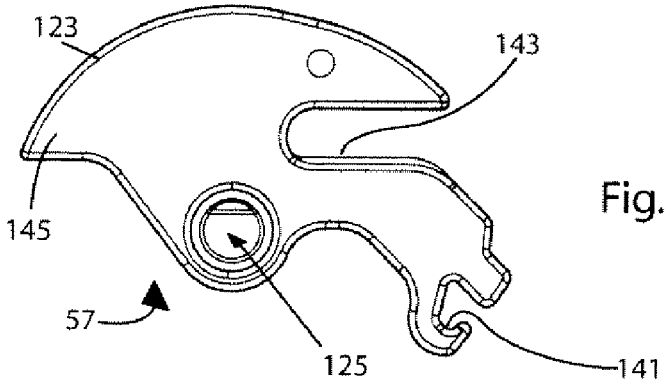
Figure 42D:
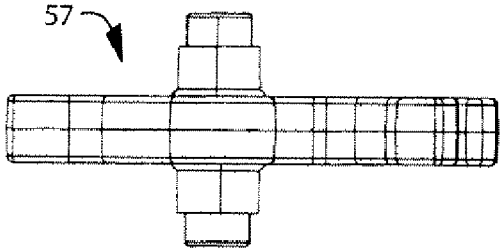
Figure 42B:
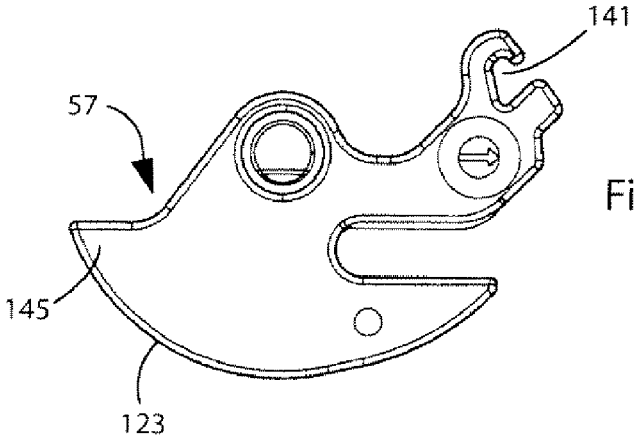

FIGS. 41*a*-41*c* perspective views of the pawl 57 with its biasing spring 61 assembled thereon and then unassembled. The spring 61 has a loop 64 which is held in the spring slot 141. The pawl stub shafts 125 are stepped with a larger diameter 125*a* inboard to hold the two coils 62 of the spring 61, and a smaller outboard diameter as the rotation shafts.

Figure 43:
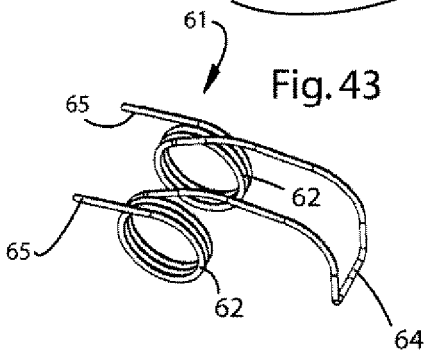
FIG. 43 is a perspective view of the rotary pawl biasing spring member.
Figure 44A:
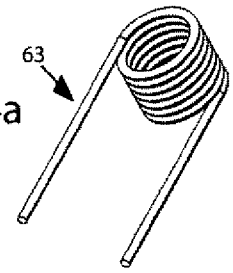
FIGS. 44*a* and 44*b* are perspective and top plan views of the paddle biasing spring member.
Figure 44B:
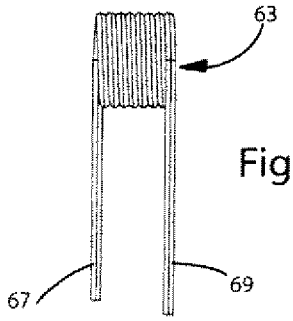

FIGS. 42*a*-42*d* show side views and top and bottom plan views of the rotating pawl 57. FIG. 43 is a perspective view of the rotary pawl biasing spring 61. FIGS. 44*a* and 44*b* show perspective and plan views of the paddle biasing spring 63.

The present invention provides a compact design for simplified panel preparation. The abutment members on the paddle 55 and housing 53 prevent over rotation. The side walls 71, 73 provide a rigid paddle with structural integrity which is not easily broken. The lock plate 59 is fully guided and runs up and down between the housing walls with ease. The interlocking with the housing 53 and the living spring action of the lock plate end feet 79 eliminates the need for an additional component, such as an extra spring to hold the lock plate 59 in a given position.

When the latch is in the closed position, the paddle sits and/or rests against the housing. The movement of the lock plate is guided by the walls of the housing and by the ends of the lock plate that ride in the guideways on the inner sidewalls of the paddle. In the closed position, the guideways are horizontal and the lock plate sits in a raised position behind the rotary pawl. The pawl, under the force from its torsion pawl spring, is rotated until it contacts the lock plate, where it is held in position.

To open the latch, the paddle is rotated from the housing about its raised pivot point. This movement permits the lock plate to move to clear the pawl for rotation. The pawl then rotates open under its torsion spring force until it meets the stop on the housing. When this occurs the top of the pawl engages the lock plate to hold it in position, whereby in turn the paddle is held in the open position and cannot return to its closed position under the force of its torsion spring.

When the paddle is rotated about 19 degrees about its raise pivot point, the guideway channels on the inner side walls of the paddle to also sit an angle and pull the lock-plate down (or up depending upon the installation orientation). The lock plate is moved by its end feet which run up and down the side wall guideway channels depending upon the movement of the paddle. As the lock plate is moved along the channels is also moves away form the pawl to clear the rotary pawl which is then free to rotate under the force of its biasing spring about 45 degrees until the pawl meets a stop on the pawl tower of the housing. As the lock plate cannot move, it does not allow the paddle to return under its biasing spring force because the lock plate ends sit in the channels and the lock plate body sits against an edge of the pawl. In this regard, the paddle spring provides the force which must be overcome when the latch is slammed to close or the paddle is pushed close. This causes the lock plate to ride over the rear edge of the pawl until the pawl is free of it and the lock plate and the paddle are returned to the closed position.

When pulling on the paddle, the movement of the guideway on the inner sidewalls of the paddle causes the lock plate to move. The interference of the lock plate, held by the rotated pawl, and the paddle causes the paddle to remain in the open position until the latch is closed. This provides a positive indication of the state of the latch. The latch is closed by pushing on the latch paddle to cause the rotary pawl to interact with the striker wire. This causes the pawl to rotate to the closed position and frees the lock plate to move to its return position. The lock plate is move to its return position by the movement of the paddle under the force of its torsion spring.

The use of a torsion spring to return the paddle tends to reduce or eliminate noise caused by a compression spring and provides a more even feel than with a compression spring. Further vibration noise is reduced because the lock plate is securely by the housing and paddle, and in both the open position and the closed position, the lock plate is in contact with another member, which minimizes movement and vibration. The leg (movement arm 155) is in constant contact with the housing 55 to further dampen vibration.

Vibration in the paddle is dampened by the paddle torsion spring. Vibration in the pawl is dampened by the pawl torsion spring.

Having a raised goose neck pivot point for the paddle means a smaller gap is required between the paddle and the glove box or panel surface. This is because the raised pivot point causes the paddle to quickly rotate away from the glove box surface when opened.

Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

The invention claimed is:

1. A low profile glove box latch assembly, comprising:

a housing;

a handle mounted to rotate on said housing with pivot walls and operable between an open and closed positions, said handle having a guideway on each wall thereon;

a handle spring to bias the handle to the closed position;

an elongated lock plate slidably carried by said handle and having an engagement portion positioned between opposed ends of the lock plate, each end being received in a respective guideway of the handle, the engagement portion having a first surface and a second surface;

a claw-shaped rotary pawl having a curved rear edge and a catch, said pawl being mounted to rotate in said housing between an open and closed positions to latch and unlatch a striker; a pawl spring to bias the pawl toward the open position; wherein when the pawl is in the closed position, the first surface of the lock plate will engage the catch to hold the pawl in the closed position;

wherein, when the handle is operated toward the open position, the lock plate will slide out of engagement with the catch, the second surface will face the pawl to allow the rotation toward the open position.

2. The glove box latch assembly of claim 1, wherein said lock plate also includes an outwardly extending movement arm, said movement arm being in constant contact with said housing.

3. The glove box latch assembly of claim 2, wherein said handle spring is a torsion spring having a first leg abutting said handle and a second leg abutting said housing; and said pawl spring is a torsion spring including a loop engaging said pawl and a pair of legs engaging said housing.

4. The glove box latch assembly of claim 3, wherein said lock plate is in abutment interference with said pawl when said pawl is in said closed position, and is in friction interference with said pawl when said pawl is in said open position, said friction interference also holding said handle in said open position.

5. A slam to close latch assembly, comprising:

a housing;

a paddle mounted to rotate on said housing between an open and closed positions, said paddle having a pair of pivot walls extending in parallel, wherein said paddle is spring biased to the closed position by a paddle spring;

a rotary pawl mounted to rotate within said housing between an open and closed positions, wherein said pawl is spring biased to the open position by a pawl spring;

a pair of juxtaposed guideway channels extending in parallel in said two parallel paddle walls;

a lock plate extending between said pair of paddle juxtaposed guideway channels and having an engagement portion positioned between opposed ends of the lock plate, each end being received in a respective guideway of the handle, the engagement portion having a first surface and a second surface; wherein when the pawl is in the closed position, the first surface of the lock plate will engage the catch to hold the pawl in the closed position;

wherein, when the handle is operated toward the open position, the lock plate will slide out of engagement with the catch, the second surface will face the pawl to allow the rotation toward the open position.

6. The latch assembly of claim 5, where said lock plate second surface engagement with said pawl is a friction engagement.

7. The latch assembly of claim 6, wherein said lock plate engages said pawl on said first surface by abutment when said paddle is in said closed position.

8. The latch assembly of claim 7, wherein said lock plate is carried by said paddle between said friction engagement and said abutment engagement by the movement of said paddle.

9. The latch assembly of claim 8, wherein said movement of said paddle from said friction to abutment engagement occurs when said paddle moves from said open to said closed positions.

10. The latch assembly of claim 9, wherein said friction engagement of said lock plate also holds said paddle in said open position, and wherein said abutment engagement holds said pawl in said closed position.

11. The latch assembly of claim 8, wherein said lock plate includes a movement arm extending therefrom to be in constant contact with said housing.

12. The latch assembly of claim 11, wherein said paddle spring is a torsion spring biasing said paddle to said closed position, having a first leg abutting said paddle and a second leg abutting said housing.

13. The latch assembly of claim 12, wherein said pawl spring is a torsion spring biasing said pawl to said open position, having a loop engaging said pawl and a pair of legs engaging said housing.

14. The latch assembly of claim 13, also including a living spring action on said lock plate operating in contact between said paddle and said housing.

15. The latch assembly of claim 14, wherein during said lock plate movement, said movement arm, said paddle and pawl torsion springs, and said living spring act to dampen vibration in said latch assembly.

16. The latch assembly of claim 15, wherein said paddle pivots on said two parallel extending walls, each wall having a pivot point which provides said paddle with a goose neck pivot; and wherein each said paddle pivot wall includes a finger which abuts said housing when said paddle reaches said open position, said abutment action of each said finger against said housing providing an audible indication of said paddle reaching said open position.

17. A latch assembly for engaging a striker, and having a housing member, comprising:

a handle mounted to rotate on said housing between open and closed positions, having pivot walls, and being spring biased to the closed position by a handle spring, each pivot wall having a guideway thereon;

a rotary pawl mounted to rotate within said housing between an open position and a closed position being spring biased to the open position by a pawl spring, said rotary pawl being engageable against said striker to move said rotary pawl to said closed position; and a lock plate slidably carried on said handle having an engagement portion positioned between opposed ends of the lock plate, each end being received in a respective guideway of the handle, the engagement portion having a first surface and a second surface; and positioned by said handle movement to engage said pawl;

wherein, wherein when the pawl is in the closed position, the first surface of the lock plate will engage the catch to hold the pawl in the closed position;

wherein, when the handle is operated toward the open position, the lock plate will slide out of engagement with the catch, the second surface will face the pawl to allow the rotation toward the open position.

18. The latch assembly of claim 17, wherein said lock plate holds said pawl with a friction contact at said second surface.

19. The latch assembly of claim 17, wherein said lock plate holds said pawl with an abutment interference contact at said first surface.

20. The latch assembly of claim 17, wherein said lock plate has a first and second faces, wherein said lock plate holds said pawl in said closed position with said first face and holds said pawl in said open position with said second face.

* * * * *

UNITED STATES PATENT AND TRADEMARK OFFICE

CERTIFICATE OF CORRECTION

PATENT NO. : 7,823,937 B2
APPLICATION NO. : 11/686568
DATED : November 2, 2010
INVENTOR(S) : Fabrice Vitry It is certified that error appears in the above-identified patent and that said Letters Patent is hereby corrected as shown below:

Column 1, line 40, reads "Some latches include a goose neck shaped handle levers"
should read -- Some latches include a gooseneck-shaped handle lever --

Column 1, line 52, reads "Both Scania, A.B., Sodertaije, Sweden and Southco, Inc.,"
should read -- Both Scania, A.B., Sodertalje, Sweden and Southco, Inc., --

Column 2, line 9, reads "The objectives the present invention are realized in a slam"
should read -- The objectives of the present invention are realized in a slam --

Column 2, line 38, reads "the pawl to engage a striker and force its rotation and thereby"
should read -- the pawl to engage a striker and force its rotation, thereby --

Column 4, line 32, reads "the paddle biasing spring member;"
should read -- the paddle biasing spring member. --

Column 4, line 41, reads "plate 59, and has a goose neck style pivot point 83. The paddle"
should read -- plate 59, and has a gooseneck style pivot point 83. The paddle --

Column 5, line 6, reads "arm walls 71, 73 are goose neck shaped. Each pivot arm wall"
should read -- arm walls 71, 73 are gooseneck-shaped. Each pivot arm wall --

Column 5, line 9, reads "bumper member 85 at the "elbow" of the goose neck shape."
should read -- bumper member 85 at the "elbow" of the gooseneck shape. --

Column 6, line 32, reads "side, on which is rotates. The pawl biasing spring 61 is"
should read -- side, on which it rotates. The pawl biasing spring 61 is --

Column 6, line 38, reads "13 and 14, in each juxtaposed side wail of the pawl cavity 127."
should read -- 13 and 14, in each juxtaposed side wall of the pawl cavity 127. --

Signed and Sealed this
Fourth Day of January, 2011

David J. Kappos

David J. Kappos
*Director of the United States Patent and Trademark Office*

Column 7, line 1, reads "a respective pawl stub shafts 101, 103 to dampen vibrations."
should read -- a respective pawl stub shaft 101, 103 to dampen vibrations. --

Column 7, line 11, reads "The paddle side wails 71, 73 establish a raised goose neck"
should read -- The paddle side walls 71, 73 establish a raised gooseneck --

Column 8, line 10, reads "close, i.e., slam to close, according to the motion arrow 153,"
should read -- close, i.e., slammed to close, according to the motion arrow 153, --

Column 8, line 58, reads "When the paddle is rotated about 19 degrees about its raise"
should read -- When the paddle is rotated about 19 degrees above its raised --

Column 8, line 60, reads "the paddle to also sit an angle and pull the lock-plate down (or"
should read -- the paddle also sit at an angle and pull the lock-plate down (or --

Column 8, line 64, reads "paddle. As the lock plate is moved along the channels is also"
should read -- As the lock plate is moved along the channels it also --

Column 8, line 65, reads "moves away form the pawl to clear the rotary pawl which is"
should read -- moves away from the pawl to clear the rotary pawl, which is --

Column 9, line 6, reads "slammed to close or the paddle is pushed close. This causes"
should read -- slammed to close or the paddle is pushed closed. This causes --

Column 9, line 19, reads "position. The lock plate is move to its return position by the"
should read -- The lock plate is moved to its return position by the --

Column 9, line 25, reads "securely by the housing and paddle, and in both the open"
should read -- securely held by the housing and paddle, and in both the open --

Column 9, line 33, reads "Having a raised goose neck pivot point for the paddle"
should read -- Having a raised gooseneck pivot point for the paddle --

Column 12, line 10-11 reads "wherein,
wherein when the pawl is in the closed position, the first"
should read -- wherein when the pawl is in the closed position, the first --